US008029965B2

(12) United States Patent
Uchino et al.

(10) Patent No.: US 8,029,965 B2
(45) Date of Patent: Oct. 4, 2011

(54) DEVELOPING ROLLER AND IMAGE FORMING METHOD EMPLOYING THE SAME

(75) Inventors: Satoshi Uchino, Tokyo (JP); Shinya Obara, Tokyo (JP); So Matsuya, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 937 days.

(21) Appl. No.: 11/972,898

(22) Filed: Jan. 11, 2008

(65) Prior Publication Data

US 2008/0220361 A1 Sep. 11, 2008

(30) Foreign Application Priority Data

Mar. 8, 2007 (JP) ..... 2007-058445

(51) Int. Cl.
*G03G 5/00* (2006.01)

(52) U.S. Cl. ..... 430/123.3; 399/286; 428/423.1; 428/447; 428/474.4

(58) Field of Classification Search ..... 430/123.3; 399/286; 428/423.1, 447, 474.4
See application file for complete search history.

(56) References Cited

U.S. PATENT DOCUMENTS

| | | | | |
|---|---|---|---|---|
| 6,376,087 | B1 * | 4/2002 | Ozeki et al. | 428/447 |
| 6,714,754 | B2 * | 3/2004 | Ozeki et al. | 399/286 |
| 6,815,134 | B2 * | 11/2004 | Kyung | 430/60 |
| 2006/0257175 | A1 * | 11/2006 | Endo et al. | 399/281 |

FOREIGN PATENT DOCUMENTS

| | | |
|---|---|---|
| JP | 2001-027843 | 1/2001 |
| WO | 2006/109563 | 10/2006 |

OTHER PUBLICATIONS

Chinese Office Action dated May 24, 2011(4 pages) with English language translation thereof (5 pages).

* cited by examiner

*Primary Examiner* — Mark Chapman
(74) *Attorney, Agent, or Firm* — Lucas & Mercanti, LLP

(57) ABSTRACT

An objective is to provide a developing roller possessing a surface layer capable of suppressing the residual potential during repetitive use with no damage of interlayer adhesiveness, preventing toner leakage and contaminations caused by adhesion matter on the surface, and preventing developing unevenness because of even toner electrification; and also to provide an image forming method employing the developing roller. Also disclose is a developing roller possessing a conductive shaft, and a resin layer provided around an outer circumferential surface of the conductive shaft, wherein the resin layer possesses a surface layer containing a silicone copolymer resin as a principal component and a layer containing a polyamide resin as a principal component, that is provided immediately below the surface layer.

5 Claims, 3 Drawing Sheets

DEVELOPING ROLLER AND IMAGE FORMING METHOD EMPLOYING THE SAME

The application claims priority from Japanese Patent Application No. 2007-058445 filed on Mar. 8, 2007, which is incorporated hereinto by reference.

TECHNICAL FIELD

The present invention relates to a developing roller used for an electrophotographic image forming apparatus such as copying machines, printers and facsimile receivers, and to an image forming apparatus employing the developing roller.

BACKGROUND

In the electrophotographic image forming method, an image is usually formed on a transfer sheet via the following processes. That is, charged toner is supplied via contact or non-contact to an electrostatic latent image formed on an electrostatic latent image carrier as an electrophotographic photoreceptor to conduct a developing treatment to visualize the electrostatic latent image, and after transferring the toner image on the electrostatic latent image onto a paper sheet an the like, a fixing treatment is conducted to form a final image.

The developing method to form the toner image on the electrostatic latent image carrier includes a double-component developing method employing a double-component developer composed of a carrier and a toner, and a single-component developing method employing a single-component developer consisting of a toner. In the single-component developing method, charging is conducted by rubbing and pressing the toner with a charging member or the surface of a developing roller without using carrier, whereby it is advantageous to obtain the simplified compact structure of the developing device. Particularly, a non-magnetic single-component developing method is suitably used for color images, and in the case of a full color image forming apparatus equipped with a plurality of developing devices such as those for yellow, magenta, yellow and black toners arranged in a limited space, image formation by the non-magnetic single-component developing method is effective.

The developing roller used for image formation by the non-magnetic single-component developing method, for example, comprises a resin layer placed on a rubber layer provided on the outer circumstance of a shaft, and a thin film of toner is formed on the developing roller by a metal plate or a roller. The thin layer of toner is charged via friction with the foregoing metal plate or the roller.

Therefore, excellent toner conveyance together with a stable charge providing property to toner is demanded for the resin layer formed on the developing roller surface, and a technique by which adhesion or fusion of the toner onto the developing roller surface is prevented has been investigated.

In the case of the thin film formation of toner carried out on the developing roller surface, a large load is applied to the toner as well as the developing roller. The improvement of durability has been desired since peeling is generated because of this unless strong adhesion is provided between the resin layer of the developing roller and a rubber layer. Consequently, a developing roller exhibiting improved durability has been disclosed, in which an intermediate layer is formed on the rubber layer prepared employing a silane coupling agent, and a resin layer formed from a fluorine resin as a principal component is further formed thereon (refer to Patent Document 1, for example).

Further, use of so-called polymerized toner producible while controlling size and shape of toner particles in the course of a manufacturing process becomes enables us to form full color pictorial images (refer to Patent Document 2, for example).

(Patent Document 1) Japanese Patent O.P.I. Publication No. 8-190263

(Patent Document 2) Japanese Patent O.P.I. Publication No. 2000-214629.

SUMMARY

Various studies have been done so far as described above, but a rise in residual potential is observed during repetitive use, since a developing roller is possibly influenced by an insulating silane coupling agent layer in the case of employing an intermediate layer in which silane coupling agent is used the in the conventional way.

It is an object of the present invention to provide a developing roller comprising a surface layer capable of suppressing the residual potential during repetitive use with no damage of interlayer adhesiveness, preventing toner leakage and contaminations caused by adhesion matter on the surface, and preventing developing unevenness because of even toner electrification; and also to provide an image forming method employing the developing roller. Disclosed is a developing roller possessing a conductive shaft, and a resin layer provided around an outer circumferential surface of the conductive shaft, wherein the resin layer possesses a surface layer containing a silicone copolymer resin as a principal component and a layer containing a polyamide resin as a principal components that is provided immediately below the surface layer.

BRIEF DESCRIPTION OF THE DRAWINGS

Embodiments will now be described, by way of example only, with reference to the accompanying drawings which are meant to be exemplary, not limiting, and wherein like elements numbered alike in several figures, in which:

FIG. 2(*b*) is a schematic diagram showing an example of a device of measuring peeling strength of a developing roller;

DESCRIPTION OF THE PREFERRED EMBODIMENTS

Figure 1:
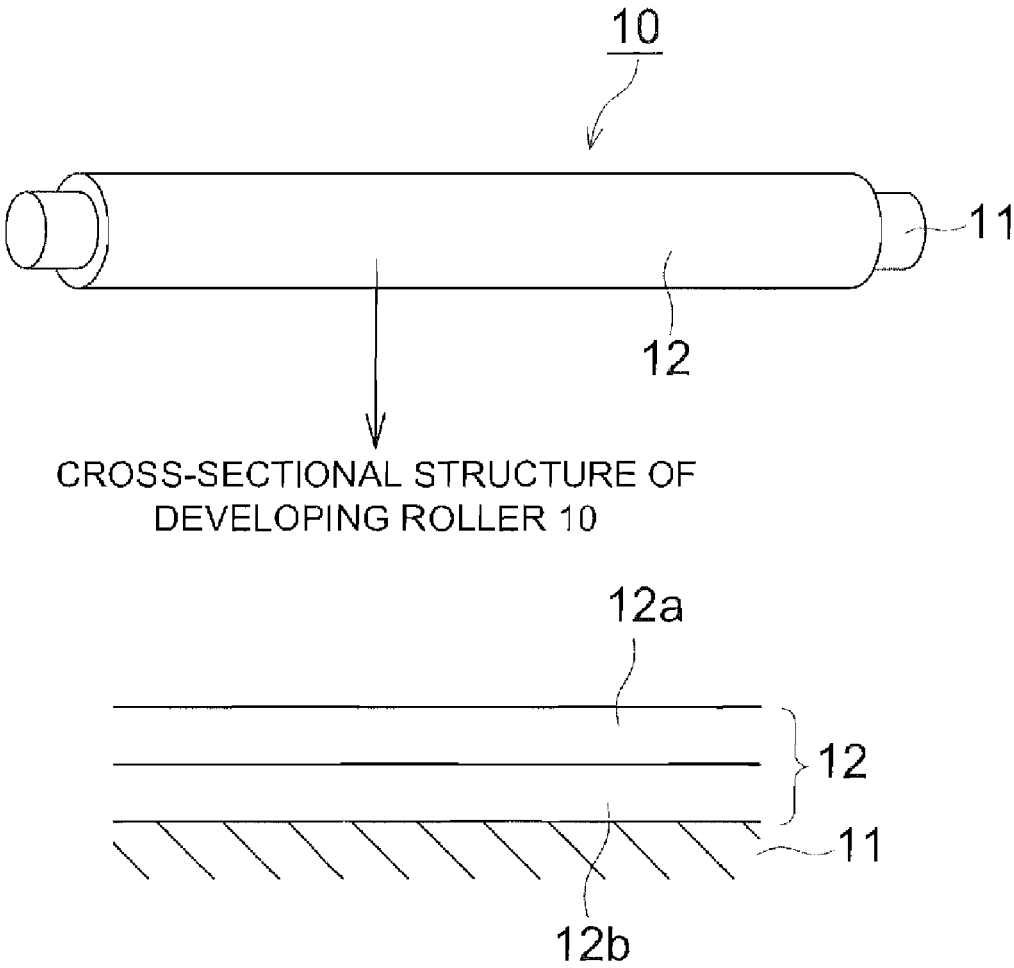
FIG. 1 is a schematic diagram showing appearance and the cross-sectional constitution of a developing roller of the present invention.

The above object of the present invention is accomplished by the following structures.

(Structure 1) A developing roller comprising a conductive shaft, and a resin layer provided around an outer circumferential surface of the conductive shaft, wherein the resin layer comprises a surface layer containing a silicone copolymer resin as a principal component and a layer containing a polyamide resin as a principal component, that is provided immediately below the surface layer.

(Structure 2) The developing roller of Structure 1, wherein the silicone copolymer resin comprises a urethane bond.

(Structure 3) A developing device employing the developing roller of Structure 1.

(Structure 4) An image forming method comprising the steps of conveying a non-magnetic single component developer to a developing region of a developing device with a developing roller; and developing an electrostatic latent image formed on an electrostatic latent image carrier with the developer, wherein the developing roller comprises a resin layer provided on an outer circumferential surface of a conductive shaft, and the resin layer comprises a surface layer containing a silicone copolymer resin as a principal component, and a layer containing a polyamide resin as a principal component, that is provided immediately below the surface layer.

(Structure 5) The image forming method of Structure 4, wherein the silicone copolymer resin comprises a urethane bond.

While the preferred embodiments of the present invention have been described using specific terms, such description is for illustrative purposes only, and it is to be understood that changes and va riations may be made without departing from the spirit or scope of the appended claims.

DETAILED DESCRIPTION OF THE INVENTION

The present invention relates to a developing roller comprising a resin layer provided around an outer circumferential surface of a conductive shaft, and particularly, the resin layer possesses a surface layer containing a silicone copolymer resin as a principal component and a layer containing a polyamide resin as a principal component, that is provided immediately below the surface layer. Concerning the present structure, in the case of specifically containing an inorganic particle component, the charge leakage point is presumably dispersed finely in the molecule. Therefore, the effect of the present invention is further enhanced since a favorable balance between appropriate charge leakage and insulation of the resin itself is achieved.

Incidentally, the term "immediately below a surface layer" is referred to as a portion under a surface layer, which is adjacently brought into contact with the surface layer.

(Technical Concept Of The Present Invention)

The resin layer provided around an outer circumferential surface of a shaft in the developing roller of the present invention comprises a surface layer containing a silicone copolymer resin as a principal component and a layer containing a polyamide resin as a principal component, that is provided immediately below the surface layer.

Occurrence of degraded image quality caused by residual potential generated via repetitive image formation is avoided in the present invention. This presumably becomes a structure in which counter charges generated on the roller surface are easy to move to a shaft by providing a resin layer directly on the conductive shaft. However, the resin layer containing no polyamide resin was not possible to produce effects of the present invention even in the case of a developing roller having the same structure. Accordingly, the polyamide resin contained in the resin layer as a principal component presumably influences some kind of action to stimulate residual charge leakage.

Further, in the present invention, adhesion between the shaft and the resin layer in the developing roller is presumably improved with high durability since the polyamide resin contained in the resin layer increases affinity of both the shaft surface and surface layer.

Further, the developing roller of the present invention possesses a surface layer comprising a silicone copolymer resin, whereby adhesion of toner and the like to the roller is prevented by lowering surface energy of the roller.

There has conventionally been a technique of utilizing a silicone resin as one concerning adhesion prevention to the roller surface, but it has been difficult to generate strong adhesion to the shaft. In the present invention, produced can be strong adhesion between an outermost surface region composed of a resin layer and a region containing a polyamide resin as a principal component, by utilizing a silicone copolymer resin to form a component having a polarity and a copolymer. Accordingly, a constituent of the silicone copolymer resin increases affinity of the polyamide resin, whereby such the adhesion is presumably generated.

When the polyamide resin is used for an intermediate layer at the same time, adhesion to a developing roller shaft made of stainless steel can be sufficiently acquired, whereby this presumably contributes to improvement of developing roller durability.

Next, the present invention is described in detail.

(Developing Roller Of The Present Invention)

The developing roller of the present invention comprises a surface layer containing a silicone copolymer resin as a principal component and a layer containing a polyamide resin as a principal component, which is provided immediately below the surface layer. The "principal component" of the present invention means that each of the silicone copolymer resin in the surface layer and the polyamide resin in the layer provided immediately below the surface layer has a content of at least 50% by weight.

FIG. 1 shows a cross-sectional constitution of a typical developing roller of the present invention Developing roller 10 possesses shaft 11 and provided thereon, resin layer 12, and there is surface layer 12*a* containing the silicone copolymer resin as a principal component on the surface of resin layer 12. There is also layer 12*b* containing a polyamide resin as a principal component, which is provided immediately below surface layer 12*a*. In FIG. 1, layer 12*a* containing the silicone copolymer resin and surface layer 12*b* containing the polyamide resin are shown as layers distinguishable via electron microscopy, but the present invention includes cases where the layer structure is somewhat difficult to be distinguishable via electron microscopy.

Shaft 11 is formed from a conductive member, and specifically a metallic material such as a stainless steel (SUS304 or such), iron, nickel, an aluminum alloy or a nickel alloy is preferable. The foregoing metal powder, and a conductive resin in which a conductive material such as carbon black is filled in a resin are also usable.

[Constitution and Property of Resin Layer]

Resin layer 12 comprises surface layer 12*a* containing the silicone copolymer resin as a principal component and layer 12*b* containing the polyamide resin as a principal component, which is provided immediately below surface layer 12*a*. The silicone copolymer resin contained in surface layer 12*a* is a resin formed from a copolymer obtained by molecular-bonding a silicon polymer having a main chain structure in which silicon bonded to an organic group and oxygen are alternatively bonded, and a polymer having a urethane bond or a vinyl polymer. Incidentally, the silicone copolymer resin usable in the present invention will be described in detail later.

Layer 12*b* constituting resin layer 12 contains a polyamide resin as a principal component. The polyamide resin contained in layer 12*b* will also be described in detail later.

Carbon black may be contained in resin layer 12 of the developing roller relating to the present invention. A certain level of conductivity is provided to the resin layer by containing carbon black in resin layer 12, whereby the remaining charge generated on the roller surface can be increasingly leaked to the shaft via the resin layer.

In the present invention, resin layer 12 preferably has a thickness of 1-30 μm, and more preferably has a thickness of 5-20 μm.

The thickness of the resin layer can be measured by sampling cross-sectional samples including the resin layer from the developing roller, and by electron microscopic micrographing the cross-sectional samples.

The resin layer formed around the conductive shaft may be one having a multilayer structure possessing a plurality of layers such as the surface layer, an intermediate layer and so forth.

(Peeling Strength Measurement of Resin Layer)

The resin layer adjacent to the conductive shaft of the developing roller relating to the present invention contains the polyamide resin, and the resin layer strongly adheres to the shaft. Peeling strength of resin layer 12 can obtained via measurement of interlayer adhesion force shown in FIG. 2, for example. The measurement is carried out by the following procedure.

Figure 2:
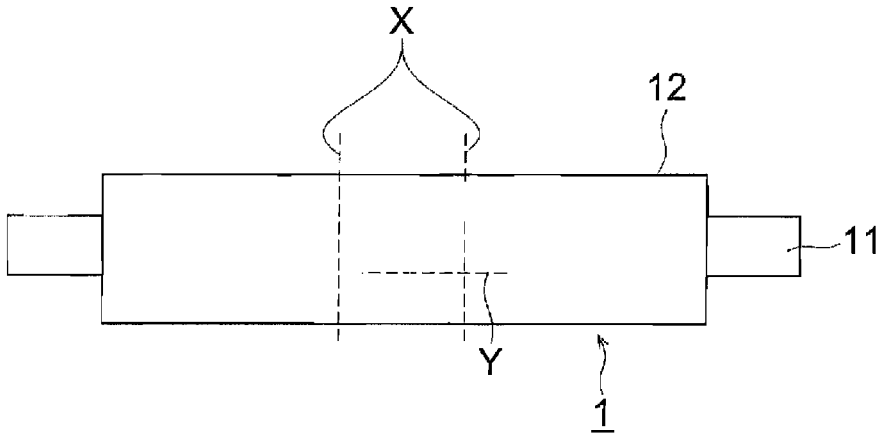
FIG. 2(*a*) is a schematic diagram showing an example of a device of measuring peeling strength of a developing roller.
Figure 2:
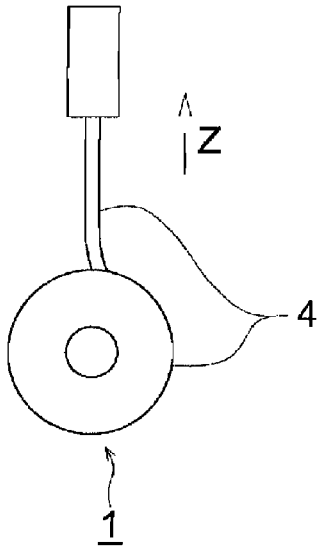

As shown in FIG. 2(*a*), incisions of the prepared developing roller 1 with a width of 2.5 cm indicated by dashed line X were made along with the outer circumferential surface of resin layer 12 at the roller center portion. An incision (dashed line Y) was further made in the shaft direction on resin layer 12 to create a section 4. Section 4 of resin layer 12 was slightly peeled from the incised portion, and then the end of peeled section 4 of resin layer 12 was raised vertically employing "Autograph AGS, manufactured by Shimadzu Corporation" (in the Z-pointing arrow direction), as shown in FIG. 2(*b*). How much force was necessary to start peeling off of section 4 of resin layer 12 out of the lower layer was measured as the peeling strength to evaluate the interlayer adhesion.

In addition, the resin layer was raised at a speed of 100 mm/min. In the process of increasing a load value to 20 N, a load value in which the resin layer was possible to be raised with no increase of load was determined as the peeling strength.

(Conductivity of Developing Roller)

Conductivity of a developing roller is possible to be evaluated via volume resistivity (called volume resistance or volume resistance value). The volume resistivity can be measured by a commonly known method In the present invention, it is assumed that appropriate conductivity appears when the developing roller volume resistivity measured by the following method is $1\times10^{1}$-$1\times10^{8}$ Ω·cm. A developing roller volume resistivity of $1\times10^{2}$-$1\times10^{7}$ Ω·cm is specifically preferable. The reason is that charge generated on the developing roller surface is appropriately leaked, and the leakage current is appropriately controlled when the developing roller volume resistivity is in the above-described range.

Figure 4:
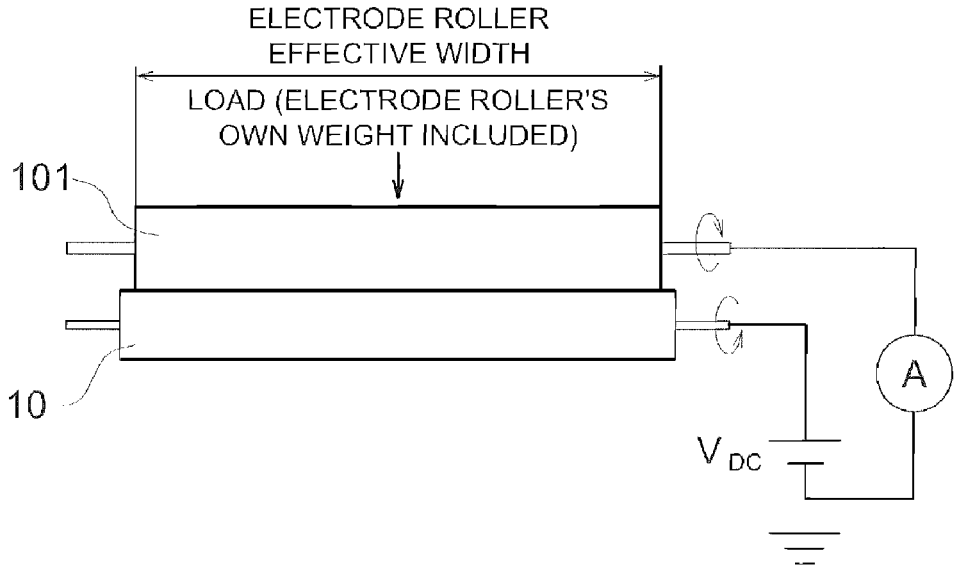
FIG. 4 is a schematic diagram to explain a method of measuring the volume resistivity of a developing roller.

The volume resistivity can be measured by a metal roller electrode method employing a typically known apparatus as shown in FIG. 4.

That is, stainless electrode roller 101 is brought into contact with developing roller 10, and pressed with a load of 9.8 N together with electrode roller 101 own weight. While rotating the roller in this situation, a voltage of +100 V is applied to an end of developing roller 10 to measure an electric current value. The volume resistivity of the developing roller is determined by using the following Formula (1).

$$R=V/I \qquad \text{Formula (1)}$$

Measuring conditions

Measurement environment: 23° C. and 57 RH%

Applied voltage: +100 V

Roller rotation speed: 27 rpm

Electrode roller load: 9.8 N (including electrode roller own weight)

Effective width of electrode roller: 230 mm (30 mm in diameter)

Measured item: Current value (applied voltage: a mean value after 5 seconds)

[Method of Preparing Developing Roller]

Next, a method of preparing a developing roller of the present invention is described below. As to the developing roller of the present invention, a coating solution containing a polyamide resin is coated on the outer-circumferential surface of a conductive shaft, and a portion containing a polyamide resin is formed via heat treatment, after coating. A coating solution containing a silicone copolymer resin is further coated on the resulting layer to prepare the developing roller of the present invention via drying and heat treatment. The preparation procedure of the developing roller of the present invention will further be described.

First, a material to form a resin layer on the outer-circumference of the conductive shaft is mixed and dissolved in an organic solvent to prepare a resin layer forming solution. Inorganic and organic particles are also possible to be contained in the resin layer forming solution, if desired. In this case, particles are dispersed in the coating solution. In the present invention, usually prepared are two kinds of solutions such as one resin layer forming solution to form the portion containing a polyamide resin and another resin layer forming solution to form the portion containing a silicone copolymer resin.

Next, the foregoing resin layer forming solution is coated on the conductive shaft. The coating method is possible to be selected depending on viscosity of the resin layer forming solution, and so forth. As the specific coating method, commonly known methods such as a dipping method, a spray method, a roller coat method and a hand-varnishing coat method are applicable. These methods are not particularly limited in the present invention.

A solvent in the resin layer forming solution is removed to form surface layer 5 via drying and heat treatment after coating (at a temperature of 120-200° C. and a treating time of 20-90 minutes) to form a resin layer.

In the present invention, the resin layer forming solution to form a portion containing a polyamide resin is first coated on a conductive shaft to prepare a layer containing a polyamide resin via heat treatment. After this, a resin layer forming solution to form a portion containing a silicone copolymer resin is further coated on the resulting resin layer to prepare a developing roller via drying and heat treatment. By such the preparation procedures, in addition to containing a silicone copolymer resin in the surface region, and obtained is a developing roller in which a resin layer containing a polyamide resin in the portion immediately below the surface region is provided on the outer circumferential surface of the conductive shaft. Next, the polyamide resin and the silicone copolymer resin contained in resin layer 12 will be described in detail.

[Polyamide Resin]

It is a feature that the polyamide resin of the present invention contains an amide component having a repeating unit structure with 7-30 carbon atoms between amide bonds in an amount of 40-100% by mole, based on the amide component of the entire repeating units, and contains an amide component having a non-straight chain repeating unit structure in an amount of at least 10% by mole, based on the amide component having a repeating unit structure with 7-30 carbon atoms between amide bonds.

The repeating unit structure with 7-30 carbon atoms between amide bonds will be described here. The foregoing repeating unit means an amide component (amide bonding unit) to form a polyamide resin. Such the matter is described below referring to examples such as polyamide resin (Type A) in which the repeating unit is formed via condensation of compounds each having both of an amino group and a carboxylic acid group and polyamide resin (Type B) in which the repeating unit is formed via condensation of a diamino compound and a dicarboxylic acid compound.

The repeating unit structure of Type A is represented by Formula (2), in which the number of carbon atoms included in X is the carbon number of the amide component in the repeating unit. On the other hand, the repeating unit structure of Type B is represented by Formula (3), in which both of the number of carbon atoms included in Y and that included in Z are each the number of carbon atoms of the amide component in the repeating unit structure.

Formula (2)

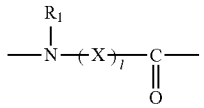

In Formula (2), $R_1$ represents a hydrogen atom or a substituted, or unsubstituted alkyl group; X represents a substituted or unsubstituted alkylene group, a group containing divalent cycloalkane group, a divalent aromatic group or a group having mixed structure of the above, and 1 is a natural number.

Formula (3)

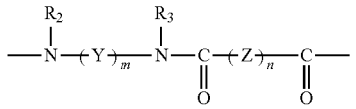

In Formula (3), each of $R_2$ and $R_3$ is a hydrogen atom, a substituted or unsubstituted alkyl group; each of Y and Z is a substituted or unsubstituted alkylene group, a group containing a divalent cycloalkane group, a divalent aromatic group or a group having mixed structure of the above; and each of m and n is a natural number.

It is a feature that the polyamide resin of the present invention contains an amide component having a non-straight chain repeating unit structure in an amount of at least 10% by mole, based on the amide component having a repeating unit structure with 7-30 carbon atoms between amide bonds. The polyamide resin is easy to possess an amorphous structure and exhibits excellent solvent solubility by containing an amide component having a non-straight chain repeating unit structure in an amount of at least 10% by mole, based on the amide component having a repeating unit structure with 7-30 carbon atoms between amide bonds. The amide component having a non-straight chain repeating unit structure preferably has a ratio of 10-75% by mole, and more preferably has a ratio of 20-50% by mole. In the case of less than 10% by mole and more than 75% by mole, the solvent solubility tends to be degraded.

The amide component having a non-straight chain repeating unit structure is referred to as a repeating unit structure possessing a branched structure or a cyclic structure in the carbon chain structure. Examples thereof include amide components having a branched alkylene group, a divalent cycloalkane-containing group, a divalent aromatic group and a mixed structure of the above, but among them, the structure having an amide component containing divalent cycloalkane is preferable.

In the polyamide resin used in the present invention, the amide component having a repeating unit structure has 7-30 carbon atoms, preferably has 9-25 carbon atoms, and more preferably has 11-20 carbon atoms. A ratio of the amide component having a repeating unit structure with 7-30 carbon atoms to the amide component of the entire repeating unit structure is 40-100% by mole, preferably 60-100% by mole, and more preferably 80-100% by mole.

In the case of less than 7 carbons, a hygroscopic property of the polyamide resin becomes large, and an electrophotographic property, particularly humidity dependency of the potential during repeating use tends to become larger In the case of more than 30 carbons, solubility of the polyamide resin to a coating solvent is deteriorated, whereby this tends to be unsuitable for the film coat formation.

When a ratio of the amide component having a repeating unit structure with 7-30 carbon atoms to the amide component of the entire repeating unit structure is less than 40% by mole, the above-described effect is reduced As a preferable polyamide resin of the present invention, polyamide having a repeating unit structure represented by Formula (1) is preferred.

Formula (1)

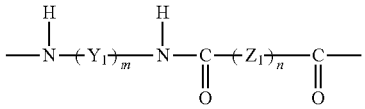

In Formula (1), $Y_1$ represents a divalent group containing an alkyl-substituted cycloalkane, $Z_1$ represents a methylene group, m is an integer of 1-3 and n is an integer of 3-20.

In Formula (1), $Y_1$ preferably has the following structure. That is, the polyamide resin of the present inventor with $Y_1$ having the following structure is preferable usable in the present invention.

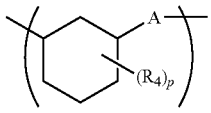

In the above-described structure, A represents a single bond, and an alkylene group having 1-4 carbon atoms; $R_4$ is a substituent, and an alkyl group; and p is a natural number of 1-5, provided that plural $R_4$s may be identical or different.

Specific examples of the polyamide resin are shown below.

N-1

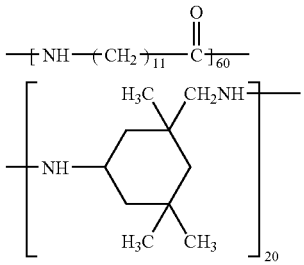

-continued
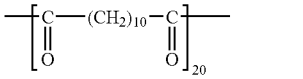
(100/20)
N-2
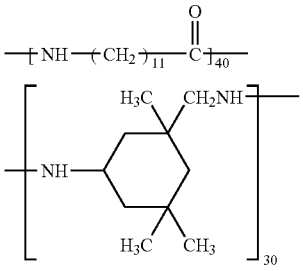
(100/30)
N-3
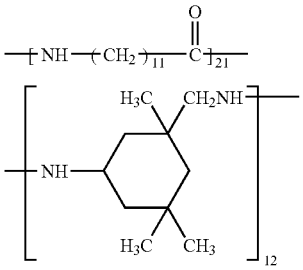
(45/27)
N-4
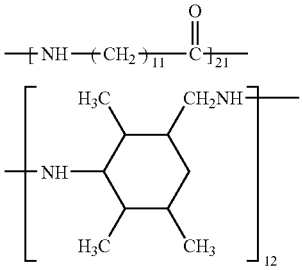
(45/27)
N-5
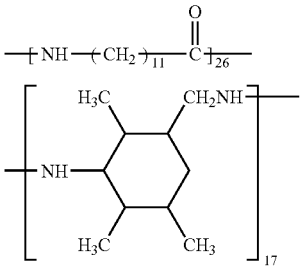
-continued
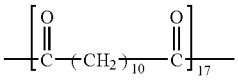
(60/28)
N-6
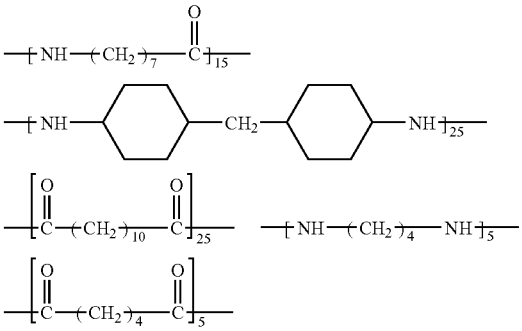
(65/38)
N-7
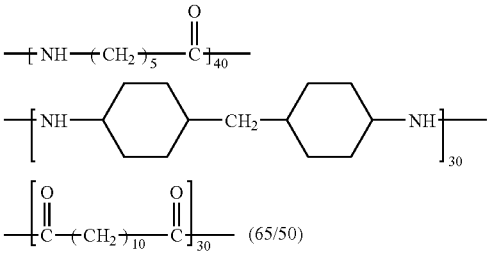
(65/50)
N-8
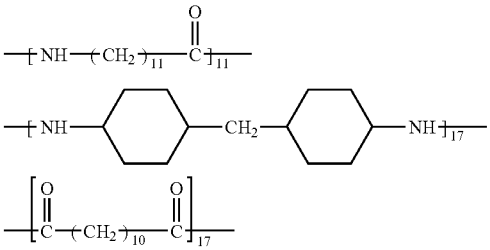
(45/38)
N-9
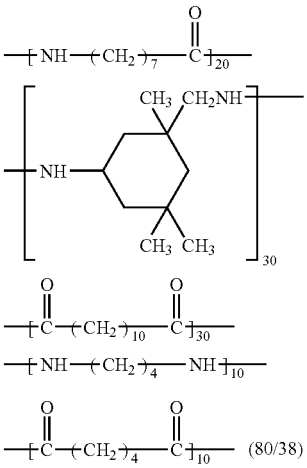
(80/38)

-continued

N-10

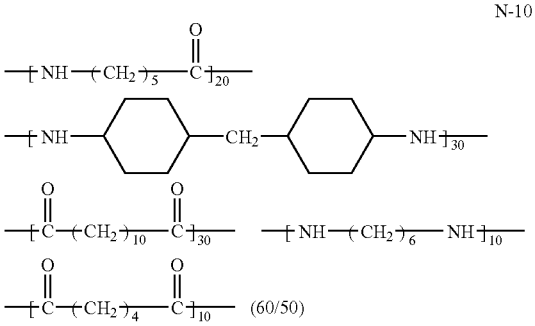

(60/50)

N-11

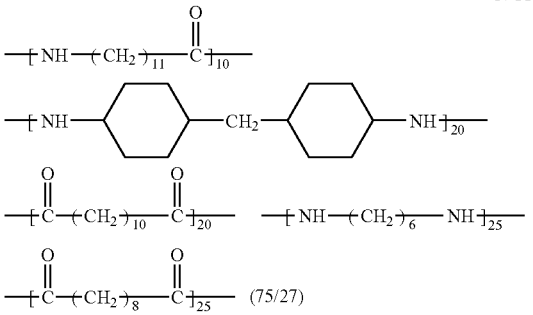

(75/27)

N-12

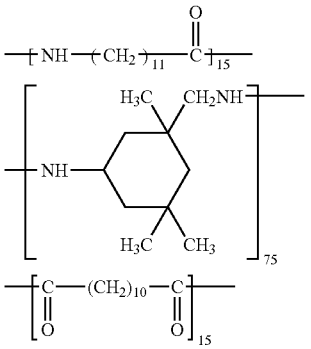

(100/75)

N-13

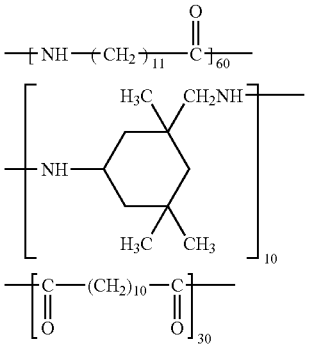

(100/10)

In the above-described specific examples, percentage shown in the parentheses (C/D) represents the ratio of a repeating unit structure with at least 7 carbon atoms between amide bonds in the repeating unit structure (C: % by mole), and the ratio of an amide component having a non-straight chain repeating unit structure in the repeating unit structure (D: % by mole).

Among the above-described specific examples, the polyamide resins of N-1-N-5, N-9, N-12 and N-13 having a repeating unit structure having an alkyl-substituted cycloalkane group represented by Formula (1) are particularly preferable.

The polyamide resin of the present invention preferably has a number average molecular weight of 5,000-80,000, more preferably has a number average molecular weight of 10,000-60,000. In the case of a number average molecular weight of less than 5,000, thickness uniformity of an intermediate layer is degraded, whereby no sufficient effect of the present invention is realized. On the other hand, in the case of a number average molecular weight of more than 80,000, solvent solubility of the resin tends to be lowered.

The polyamide resins of the present invention, for example, VESTAMELT X1010 and X4685, manufactured by Daicel-Degussa Ltd., are commercially available, and prepared by a conventional synthesis method. An example of the synthesis method is described below.

Synthesis of Exemplified Polyamide Resin (N-1)

In a polymerization kettle fitted with a stirrer, nitrogen, a nitrogen gas introducing pipe, a thermometer and a dehydration pine, mixed were 215 parts by wight of lauryllactam, 112 parts by weight of 3-aminomethyl-3,5,5-trimethylcyclohexylamine, 153 parts by weight of 1,12-dodecane dicarboxylic acid and 2 parts by weight of water to react under the condition of heating and applied pressure for 9 hours while removing water by distillation. The resulting polymer was removed and the copolymer composition was determined via $C^{13}$-NMR. As a result, the polymer composition coincided with that of N-1. In addition, melt flow index (MFI) of the above-synthesized copolymer was 5 g/10 min under the condition of 230° C./2.16 kg.

As a solvent to prepare a coating solution, alcohols having 2-4 carbon atoms such as ethanol, n-propyl alcohol, isopropyl alcohol, n-butanol, t-butanol and sec-butanol are preferable in view of solubility of polyamide and coatability of the prepared coating solution. These solvents are employed in a ratio of 30-100% by weight in the total solvent amount, preferably in a ratio of 40-100% by weight, and more preferably in a ratio of 50-100% by weight. Examples of the solvent aid to produce a preferable effect in combination with the foregoing solvents include methanol, isopropyl alcohol, benzyl alcohol, toluene, methylene chloride, cyclohexanone and tetrahydrofuran and so forth.

[Silicone Copolymer Resin]

Next, a silicone copolymer resin contained as a principal component in surface region 12*a* of resin layer 12 will be described below. Resin layer 12 constituting developing roller 10 of the present invention has region 12*a* containing the silicone copolymer resin around the surface region. The silicone copolymer resin contained around the surface region is not particularly limited, but specifically, one capable of forming a copolymer with a compound having a urethane bond or a vinyl polymer is preferable.

As a specific example of the silicone copolymer resin usable in the present invention, a silicone copolymer resin constituting a copolymer with a compound having a urethane bond, and a silicone copolymer resin constituting a copolymer with a vinyl polymer will be described here.

The silicone copolymer resin constituting a copolymer with a compound having a urethane bond (hereinafter, referred to as a silicone copolymer urethane resin) can be synthesized from a compound having a silicone bond, and also having at least two polyisocyanate groups and at least two hydroxyl groups in the molecule of these, a silicone copolymer urethane resin having a JIS A hardness of 60-90° and a 100% modulus of $5\times10^6$-$30\times10^6$ Pa is preferable.

The silicone polymer resin is not particularly limited, but one prepared by a method disclosed in Japanese Patent Examined Publication No. 7-33427, for example, is preferable. Namely, it is a polyurethane based resin having a copolymer component of caprolactone and specifically a siloxane compound containing active hydrogen in at least a part of a polyol component among polyurethane based resins prepared employing a polyol component, an polyisocyanate component and a chain extender, if desired. In this way, as one of polyurethane based resins useable in the present invention, provided is one prepared employing polyol having a copolymer componenet of caprolactane and a siloxane compound containing active hydrogen in at least of the structure As a specific example of the siloxane compound containing active hydrogen which are usable in the present invention, the following compounds are prederred.

(1) Amino-modified siloxane oil

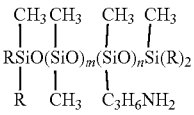

(m = 1 to 10, n = 2 to 10 and R = $CH_3$ or $OCH_3$)

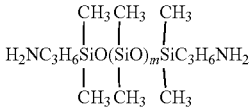

(m = 0 to 200)

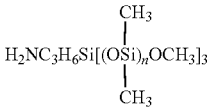

(n = 2 to 10)

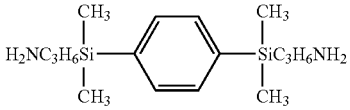

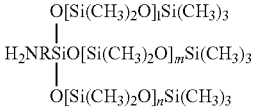

(Blanched point = 2 to 3,
R = a lower alkyl group
l = 2 to 200, m = 2 to 200 and n = 2 to 200)

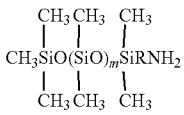

(n = 1 to 200 and R = a lower alkyl group)

(2) Epoxy-modified siloxane oil

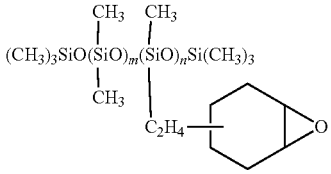

(m = 1 to 10, and n = 2 to 10)

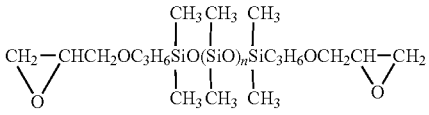

(n = 1 to 200)

-continued

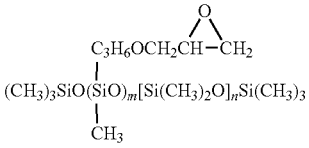

(m = 1 to 10, and n = 2 to 10)

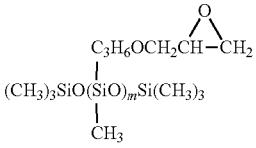

(m = 1 to 10)

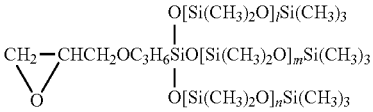

(Blanched point = 2 to 3, l = 2 to 200,
m = 2 to 200 and n = 2 to 200)

The above-described epoxy compounds are usable via reaction with polyol, polyamine or polycarboxylic acid so as to have active hydrogen at the terminal.

(3) Alcohol-modified siloxane oil

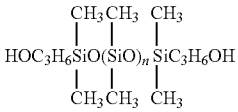

(n = 1 to 200)

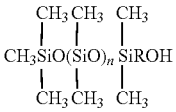

(n = 1 to 200 and
R = a lower alkyl group)

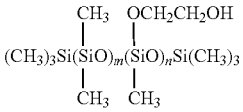

(m = 1 to 10 and n = 2 to 10)

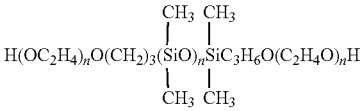

(n = 0 to 200)

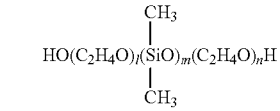

(l = 1 to 10, m = 10 to 200 and n = 1 to 5)

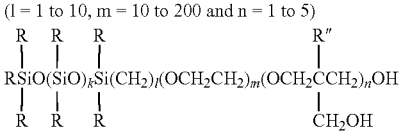

(R = a lower alkyl group,
R″ = a hydrogen atom or
a lower alkyl group, k = 1 to 250,
l = 0 to 5, m = 0 to 50 and n = 1 to 3)

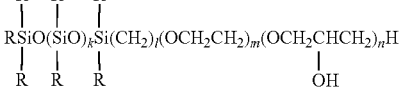

(R = a lower alkyl group, k = 1 to 250,
l = 0 to 5, m = 0 to 50 and n = 1 to 3)

-continued (4) Mercapto-modified siloxane oil

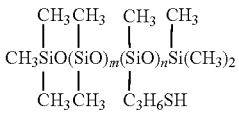

(m = 1 to 10 and n = 2 to 10)

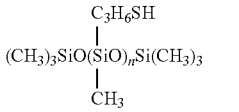

(n = 2 to 10)

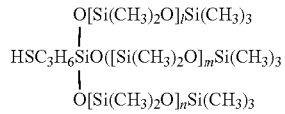

(Branched point = 2 to 3, l = 2 to 200, m = 2 to 200 and n = 2 to 200)

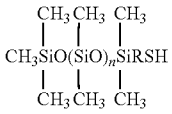

(n = 1 to 200 and R = a lower alkyl group)

(5) Carboxyl-modified siloxane oil

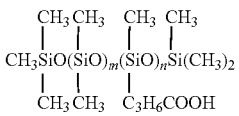

(m = 1 to 10 and n = 2 to 10)

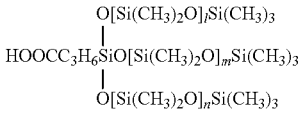

(Branched point = 2 to 3, l = 2 to 200, m = 2 to 200 and n = 2 to 200)

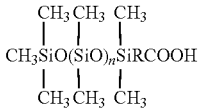

(m = 1 to 200 and R = a lower alkyl group)

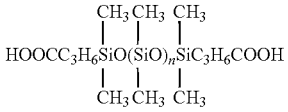

(n = 1 to 200)

The above-described siloxane compounds containing active hydrogen are usable examples of compounds in the present invention, and the present invention is not limited thereto. In addition, the above-described siloxane compounds is possible to be incorporated in polyurethane via reaction of an NCO group at the terminal with the polyurethane after polymerizing a monofunctional compound with caprolactone.

The ϵ-caprolactone capable of reacting with the siloxane compound containing active hydrogen is represented by the following formula.

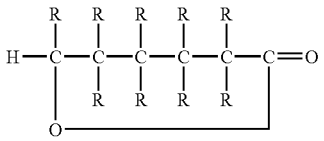

Specifically, a monoalkyl-ϵ-caprolactone such as ϵ-caprolactone, monomethyl-ϵ-caprolactone, monoethyl-ϵ-caprolactone, monopropyl-ϵ-caprolactone or monododecyl-ϵ-caprolactone is exemplified. Dialkyl-ϵ-caprolactones, trialkyl-ϵ-caprolactones, alkoxy-ϵ-caprolactones such as ethoxy-ϵ-caprolactone and the like, cycloalkyl-ϵ-caprolactones, aryl-ϵ-caprolactones and aralkyl-ϵ-caprolactones are further cited.

The siloxane-modified polycaprolactone copolymer which is a copolymer of the foregoing siloxane compound and the above-described caprolactone can be obtained by mixing and reacting both of the compounds at a temperature of from 150 to 200° C. for several hours to about 10 hours by preferably using an appropriate catalyst under nitrogen gas stream. The siloxane compound and the caprolactone are possible to be reacted at an arbitrary reaction ratio, but the ratio of 10-80 parts by weight of the siloxane compound to 100 parts by weight of the caprolactam is preferable. The resulting polyurethane based resin obtained through the siloxane-modified polycaprolactone copolymer prepared at the foregoing ratio exhibits high adhesion, blocking resistance and high transparency.

Further usable is an intermediate layer obtained via reaction of the above-described copolymer with the after-mentioned polyisocyanate in such a way that at least one of a hydroxyl group in the copolymer and an isocyanate in the polyisocyanate group is left over. As examples of such the foregoing intermediate layer, also usable is an intermediate layer obtained via reaction of a bifunctional copolymer with polyfunctional polyisocyanate in an isocyanate group rich amount, or in a reactive group (in the copolymer) rich amount.

Further, polyester polyol and the like obtained via reaction of a copolymer with a polycarboxylic acid are similarly usable.

Any of commonly known polyurethane polyols is usable as the polyol employed in combination with the foregoing siloxane modified polycaprolactone copolymer, and preferable examples thereof include those having a number average molecular weight of 300-4000, and having a hydroxyl group as a terminal group such as polyethylene adipate, polyethylenepropylene adipate, polyethylenebutylene adipate, polydiethylene adipate, polybutylene adipate, polyethylene succinate, polybutylene succinate, polyethylene sebacate, polybutylene sebacate, polytetramethylene ether glycol, poly-ϵ-caprolactone diol, polyhexamethylene adipate, carbonate polyol and polypropylene glycol, or those containing an appropriate amount of a polyoxyethylene chain in the above-described polyol.

Any of commonly known organic polyisocyanates is usable, and usable examples thereof include 4,4'-diphenylmethane diisocyanate (MDI), water-added MDI, isophorone diisocyanate, 1,3-xylylene diisocyanate, 1,4-xylylene diisocyanate, 2,4-tolylene diisocyanate, 2,6-tolylene diisocyanate, 1,5-naphthalene diisocyanate, m-phenylene diisocyanate and p-phenylene diisocyanate. A urethane prepolymer having isocyanate at the terminal is possible to be used by reacting low molecular weight polyol and polyamine together with such the organic polyisocyanate.

Commonly known chain extenders are usable, and usable examples thereof include ethylene glycol, propylene glycol, diethylene glycol, 1,4-butanediol, 1,6-hexanediol, ethylenediamine, 1,2-propylenediamine, trimethylenediamine, tetramethylenediamine, hexamethylenediamine, decamethylene diamine, isophorone diamine, m-xylylene diamine, hydrazine, water and so forth.

Of these polyurethane based resins obtained from the foregoing material, a polyurethane based resin with the content of siloxane-caprolactone copolymer segment being 10-80% by weight, based on a polyurethane based resin molecule is specifically preferable, and properties such as non-adhesiveness, blocking resistance, transparency and flexibility are to be generated at the same time. Further, a molecular weight of 20,000-500,000 is preferable, and that of 20,000-260,000 is more preferable.

Further, a polyurethane based resin having at least one released isocyanate group is produced via reaction of the above-described copolymer with polyisocyanate in isocyanate richness, and the resulting can be used in combination with a coated film-forming resin to be utilized as a modifying agent.

A polyurethane based resin containing the above-described siloxane caprolactone copolymer segment can be prepared by a commonly known method. These polyurethane based resins may be prepared in a solventless process, or in an organic solvent, but the preparation in the organic solvent is of advantage, since the resulting solution can be directly utilized for many purposes. Examples of organic solvents usable for preparation include methylethyl ketone, methyl-n-propyl ketone, methylisobutyl ketone, diethyl ketone, methyl formate, ethyl formate, propyl formate, methyl acetate, ethyl acetate, butyl acetate, acetone, cyclohexane, tetrahydrofuran, dioxane, methanol, ethanol, isopropyl alcohol, butanol, toluene, xylene, dimethylformamide, dimethylsulfoxide, perchloroethylene, trichloroethylene, methylcellosolve, butylcellosolve, and cellosolve acetate.

Next, silicone copolymerization vinyl copolymer will be described below. As a silicone based macromonomer usable for a method of preparing a silicone based graft copolymer, a linear silicone molecule having a (meth)acryl group at one of the terminals thereof is preferable. Among them, one having a number average molecular weight of 1,000-100,000 in terms of polystyrene conversion by gel permeation chromatography is capable of polymerizing a silicone based macromonomer without remaining unreacted silicone, together with remaining an original silicone property such as lubricity.

As a method of preparing a silicone based macromonomer, the following methods are applicable.

(1) A Method to Utilize Anionic Polymerization

A silicone living polymer is obtained by polymerizing cyclic trisiloxane or cyclic tetrasiloxane employing a polymerization initiator such as lithium trialkylsilanolate. This is a preparation method by reacting the resulting with γ-methacryloyloxypropyl monochlorodimethyl silane (refer to Japanese Patent O.P.I. Publication No. 59-78236).

(2) A Method to Utilize Condensation Reaction

This is a method of preparing a macromonomer via condensation reaction of silicone having a silanol group at the terminal with γ-methacryloyloxypropyl trimethoxy silane (refer to Japanese Patent O.P.I. Publication Nos. 58-167606 and 60-123518).

The radical polymerizable monomer polymerized with a silicone based macromonomer is a monomer constituting a trunk polymer of a graft copolymer, and one having a (meth) acrylic monomer as the principal component selected from (meth)acrylate or (meth)acrylic acid is preferable. Specifically, it is preferable that the content of the acrylic monomer unit in the trunk polymer has a content of at least 50% by weight, based on the total amount of the monomer unit constituting the trunk polymer. Specifically, in the case of a content of more than 50 by weight, based on the total amount of the monomer unit constituting the trunk polymer, adhesion of a coated layer can be obtained.

Examples of the (meth)acrylic monomer include alkyl (meth)acrylate such as methyl (meth)acrylate, ethyl (meth) acrylate, n-propyl (meth)acrylate, n-butyl (meth)acrylate, isobutyl (meth)acrylate, t-butyl (meth)acrylate, 2-ethylhexyl (meth)acrylate, lauryl (meth)acrylate, stearyl (meth)acrylate or isobornyl (meth)acrylate; hydroxyalkyl (meth)acrylate such as hydroxyethyl (meth)acrylate, hydroxypropyl (meth) arylate or hydroxybutyl (meth)acrylate; ethylene oxide-modified hydroxyl (meth)acrylate, lactone-modified hydroxyl (meth)acrylate, acrylic acid and methacrylic acid.

Radical polymerizable monomers other than the above-described monomers are also usable, if desired. Examples thereof include styrene, (meth)acrylonitrile, vinyl acetate, (meth)acrylamide, itaconic acid and maleic acid.

Further, an organic silicon monomer such as vinyltriethoxy silane or γ-methacryloxypropyltrimethoxy silane, or a bifunctional monomer such as allyl methacrylate or allyl phthalate is possible to be used in combination with the above-described radical polymerizable monomer during preparation of a graft copolymer, and the addition amount is an amount to such a degree that no gelation is generated.

An addition amount of the silicone based macromonomer in radial polymerization to obtain the graft copolymer is 10-60% by weight, based on the total amount of the whole monomers to form a copolymer, and preferably 20-40% by weight. When the addition amount of the silicone based macromonomer is within the above-described range, the graft copolymer exhibiting excellent lubricity can be obtained, and no separation of the silicone based macromonomer is caused during polymerization in the solvent system as well as storing of the graft copolymer.

The usable polymerization initiator is not particularly limited, but a radical polymerization initiator composed of an azo compound is preferable. Specifically, examples thereof include dimethyl-2,2'-azobisisobutylate, 1,1'-azobis-(1-acetoxy-1-phenylethane), 2,2'-azobis(2,4,4-trimethylpentane), 2,2'-azobis(2-methylpropane), 2,2'-azobis-2,4-dimethylvaleronitrile and 1,1'-azobis-1-cyclohexane carbonitrile.

The addition amount of the polymerization initiator is preferably 0.01-10% by -weight, based on the total amount of the polymerizable component, and more preferably 0.1-5% by weight. The temperature during copolymerization is preferably 50-150° C., and more preferably 60-100° C. The polymerization duration is preferably 5-25 hours.

In the case of conducting the above-described radical polymerization by a solution polymerization method, examples of usable solvents include a ketone based solvent such as acetone, methylethyl ketone or methyl isobutyl ketone; an acetate ester based solvent such as ethyl acetate and butyl acetate; cyclohexane; tetrahydrofuran; dimethylformamide; dimethylsulfoxide; and hexamethylphosphoamide, and the ketone based solvent and the acetate ester based solvent are more preferable. The above-described solvent becomes a good solvent for silicone and the resulting graft copolymer in comparison to other organic solvents, and the remaining case of unreacted silicone is lowered.

As to the preferable average molecular weight, the graft polymer has a weight average molecular weight of 50,000-500,000 in terms of polystyrene conversion via GCP measurement.

(Action of Resin for Surface Layer)

The polyurethane based resin exhibiting excellent non-adhesion, blocking resistance and flexibility together with excellent transparency can be provided by introducing a copolymer segment of a siloxane compound and caprolactone into the polyurethane based resin.

[Image Forming Method]

Next, an image forming method of the present invention will be described. The developing roller of the present invention is preferably utilized for the image forming apparatus employing a non-magnetic single-component developer to form images with a developer composed only of toner substantially without using a carrier, though external additives are often added.

The developing roller of the present invention is installed in a developing device to supply toner onto an image carrier to form an electrostatic latent image. The developing device possesses a toner layer regulating member and an auxiliary toner supply member together with the developing roller, and these members are placed so as to be touched. In the developing apparatus, a thin layer of toner is formed on the developing roller via the toner layer regulating member and the auxiliary toner supply member, and the toner layer is supplied onto the image carrier to visualize the latent images.

The toner layer regulating member supplies toner on to a developing roller in the form of a thin film to conduct friction electrification of the toner. A material flexible at some level such as urethane rubber or a metal plate is used for the toner layer regulation member, and a thin layer of toner is formed on the developing roller by being brought into contact with the developing roller. The thin layer of toner formed on the developing roller has a thickness of at most 10 toner particles in size, and preferably has a thickness of at most 5 toner particles in size.

The contact force of the toner layer regulating member to the developing roller is preferably from 100 mN/cm to 5 N/cm and particularly preferably from 200 mN/cm to 4 N/cm. When the contact force is within the above range, occurrence of image defects such as white streak and so forth can be avoided since toner conveyance can be conducted without generating conveyance irregularity. Moreover, the toner can be supplied onto the developing roller with no deformation and crushing of the toner by setting the contact force within the above range.

The auxiliary toner supply member is provided to stably supply the toner onto the developing roller. A water wheel-shaped roller equipped with stirring wings or a sponge roller is used for the toner supply assistant member. The size (diameter) of the auxiliary toner supply member is preferably 0.2-1.5 times the developing roller in size. The toner can be supplied neither too much nor too little with such the auxiliary toner supply member, whereby excellent images with no defect are possible to be formed.

As an image carrier used for the image forming method of the present invention, an inorganic photoreceptor, an amorphous silicon photoreceptor and an organic photoreceptor are usable. Among them, the organic photoreceptor is particularly preferable and a multilayer structure having a charge transfer layer and a charge generation layer is preferred.

Next, the developing device (developing unit) usable for an image forming method of the present invention will be specifically explained.

Figure 3:
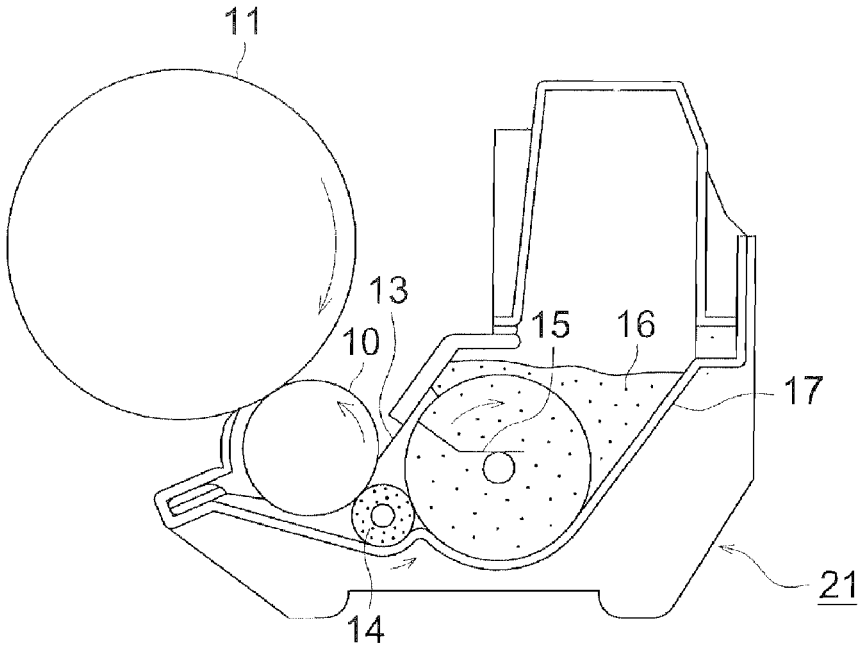
FIG. 3 is a schematic cross-sectional illustration of a developing device usable for an image forming method of the present invention.

FIG. 3 is a schematic cross-sectional illustration of a developing device 21 usable for an image forming method of the present invention.

In FIG. 3, non-magnetic single component toner 16, stored in toner tank 17, is conveyed and supplied onto sponge roller 14 as an auxiliary toner supply member, employing stirring blade 15 as the auxiliary toner supply member. Toner adhered on the sponge roller is conveyed to developing roller 10 via rotation in the arrowed direction of sponge roller 14, and is electrostatically and physically adsorbed onto its surface due to friction with developing roller 10.

The toner adhered onto developing roller 10 is subjected to uniformly thin-layering by rotation of developing roller 10, together with flexible blade 13 as a toner layer thickness regulating member, and is also subjected to frictional electrification. The thin layer of toner formed on developing roller 10 is supplied onto photoreceptor 11 as an image carrier via a contact or non-contact process to develop a latent image.

In addition, the constitution of the developing unit in which the developing roller of the present invention can be installed is not limited to one shown in FIG. 3.

As a fixing method usable for an image forming method of the present invention, a fixing process such as a so-called contact heating process is provided, arid the contact-heating process includes a heat-pressing fixing process, a heat-roll fixing process, and a pressing contact heat-fixing-process in which fixing is conducted by a rotary pressing member including a steadily placed heater.

The heat-roll fixing process is operated by an upper roller and a lower roller, wherein the upper roller contains a heat source inside the metal cylinder made of iron or aluminum covered with tetrafluoroethylene, polytetrafluoroethylene-perfluoroalkoxyvinyl ether copolymer or such, and the lower roller is made of a silicone rubber or others. A linear heater is provided as a heat source and is usually employed to heat the upper roller to a surface temperature of about 120-200° C. In the fixing section, pressure is applied between the upper roller and lower roller to deform the lower roller, whereby a so-called nip is formed. The nip width is 1-10 mm, preferably 1.5-7 mm. The fixing linear speed is preferably 40-600 mm/sec. When the nip width is small, heat can not be applied uniformly, and uneven fixing will occur. If the nip width is large, resin fusion will be accelerated and a problem of excessive fixing offset will arise A fixing cleaning mechanism may be provided to be utilized. As to this process, it is possible to use a process of supplying silicone oil to a fixing upper roller or film, or a cleaning process employing a pad, a roller, a web or such impregnated with silicone oil.

In the present invention, also usable is a process in which a rotary pressing member including a steadily placed heater is employed for fixing.

This fixing process is a pressing contact heat-fixing process in which fixing is conducted with a fixed heating body and a pressing member by which contact-pressing facing the heating body is applied, and a recording material is attached to the heating body via a film.

This pressing contact heat-fixing device is equipped with a heating body having a smaller heat capacity than that of a conventional heating body, and has a heating portion in the form of lines at a right angle to the passing direction of the recording material. The maximum temperature of the heating portion is usually 100-300° C.

[Developer]

Next, the developer usable for image formation with a developing roller of the present invention will be described. The toner used for image formation with a developing roller of the present invention is a crushed toner produced through a crushing and classification process, or a so-called polymerized toner produced directly via a polymerization process to prepare resin particles, and the both cases are usable. Among them, the polymerized toner is favorable in view of producing toners having evenly-shaped small particles in size, since the size of the toner particle can be controlled during the preparation process.

Formation of high resolution and high definition images can easily be conducted by using small particle toners having evenly-shaped small particles in size, and such the toner is particularly preferable to form a pictorial full color image with high gradation. It is expected that a high definition full color image can be stably formed by combining such the toner with the developing roller of the present invention.

On the other hand, the preparation process of the polymerized toner includes a process to coagulate particles, but it is expected that a slight amount of coagulant used for coagulation of the particles remains on the toner particle surface. There is a problem such that leakage of the remaining charge of the developing roller surface is weakened by attaching the remaining material on the toner particle surface to the developing roller.

However, it is confirmed via the after-mentioned results of examples that the remaining charge on the developing roller surface is not raised and image formation is suitably conducted even though image formation is repeatedly carried out with the polymerized toner in an image forming apparatus equipped with the foregoing developing roller.

Next, described will be elements constituting the polymerized toner as an example of toner usable for image formation with the developing roller of the present invention.

(Monomer)

As a polymerizable monomer, a radically polymerizable monomer is employed as a mandatory component, and a crosslinking agent is usable, if desired. It is also preferable to contain at least one kind of radically polymerizable monomers having the following acidic group or basic group.

(1) Radically Polymerizable Monomer

Radically polymerizable monomers are not particularly limited, and commonly known radically polymerizable monomers are usable. These monomers can be used singly or in combination with at least two kinds in order to satisfy desired properties.

Specifically, usable examples thereof include an aromatic vinyl monomer, a (meth)acrylic acid ester based monomer, a vinyl ester based monomer, a vinyl ether based monomer, a monoolefin based monomer, a diolefin based monomer and a halogenated olefin based monomer.

Examples of the aromatic vinyl monomer include a styrene based monomer such as styrene, o-methylstyrene, m-methylstyrene, p-methylstyrene, p-methylstyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecyl styrene, 2,4-dimethylstyrene or 3,4-dichlorostyrne, and a derivative thereof.

Examples of the ester acrylate based monomer include methyl acrylate, ethyl acrylate, butyl acrylate, acrylic acid-2-ethylhexyl, cyclohexyl acrylate, phenyl acrylate, methyl methacrylate, ethyl methacrylate, butyl methacrylates, hexyl methacrylate, methacrylic acid-2-ethylhexyl, b-hydroxyacrylic acid ethyl, g-aminoacrylic acid propyl, stearyl methacrylate, dimethy-laminoethyl methacrylate and diethylaminoethyl methacrylate.

Examples of the vinyl ester based monomer include vinyl acetate, vinyl propionate, vinyl benzoate and so forth.

Examples of the vinyl ether based monomer include vinylmethyl ether, vinylethyl ether, vinylisobutyl ether, vinylphenyl ether and so forth.

Examples of the monoolefin based monomer include ethylene, propylene, isobutylene, 1-butene, 1-pentene, 4-methyl-1-pentene and so forth.

Examples of the diolefin based monomer include butadiene, isoprene, chloroprene, and so forth.

Examples of the halogenation olefin based monomer include vinyl chloride, vinylidene chloride, vinyl bromide and so forth.

(2) Crosslinking Agent

A radical polymirizable crosslinking agent may be added as a crosslinking agent in order to improve toner characteristics. A crosslinking agent having at least two unsaturated bonds such as divinylbenzne, divinylnaphthalene, divinylether, diethylene glycol methacrylate, ethylene glycol dimethacrylate, polyethylene glycol dimethacrylate or diallyl phthalate is provided as the radically polymerizable cross linking agent.

(3) Radically Polymerizable Monomer having an Acidic Group or Radically Polymerizable Monomer having a Basic Group Usable examples of the radically polymerizable monomer having an acidic group or the radically polymerizable monomer having a basic group include a carboxyl group-containing monomer, a sulfonic acid group-containing monomer, and amine based compounds such as primary amine, secondary amine, tertiary amine and quaternary ammonium salt.

Examples of the radically polymerizable monomer having an acidic group include an acrylic acid, a methacrylic acid, a fumaric acid, a maleic acid, an itaconic acid, a cinnamic acid, a maleic acid monobutyl ester a maleic acid monooctyl ester and so forth.

Examples of the sulfonic acidic group-containing monomer include styrene sulfonic acid, allylsulfosuccinic acid, allylsulfosuccinic acid octyl and so forth.

These may be a structure of alkaline metal salt such as sodium or potassium, or a structure of alkaline earth metal salt such as calcium.

Examples of the radically polymerizable monomer having a basic group include amine based compounds such as dimethylamino ethyl acrylate, dimethylamino ethyl methacrylate, diethylaminoethyl acrylate, diethylaminoethyl methacrylate and quarternary ammonium salts of the above-described four compounds, and 3-dimethylaminophenyl acrylate, 2-hydroxy-3-methacryloxypropyltrimethyl ammonium salt, acrylamide, N-butylacrylamide, N,N-dibutylacrylamide, piperidylacrylamide, methacrylamide, N-butylmethacrylamide, N-octadecylacrylamide; and vinylpyridine, vinyl pyrrolidone, vinyl-N-methylpyridinium chloride, vinyl-N-etlhylpyridinium chloride, N,N-diallylmethyl ammonium chloride, and N,N-diallylethyl ammonium chloride.

As for a radically polymerizable monomer, the content of the radically polymerizable monomer having an acidic group or the radically polymerizable monomer having a basic group is preferably 0.1-15% by weight, based on the total radically polymerizable monomer, and more preferably 0.1-10% by weight, though depending on the properties of a radically polymerizable crosslinking agent.

(Chain Transfer Agent)

Commonly known chain transfer agents are usable for the purpose of adjusting a molecular weight.

Chain transfer agents are not particularly limited, and usable examples thereof include octylmercaptan, dodecylmercaptan, tert-dodecylmercaptan, n-octyl-3-mercaptopropionic acid ester, carbon tetrabromide and styrene dimmer.

(Polymerization Initiator)

A radical polymerization initiator of the present invention is suitably usable, provided that it is water-soluble. Examples thereof include persulfates such as potassium persulfate, ammonium persulfate and so forth; azo based compounds such as 4,4'-azobis-4-cyano valeric acid, a salt thereof and 2,2'-azobis(2-amidinopropane) salt; and a paroxide compound.

Further, the above-described radically polymerizable monomer can be a redox based initiator in combination with a reducing agent, if desired. It is expected that polymerization is activated by using the redox based initiator, the polymerization temperature can be lowered, and the polymerization time can further be shortened.

The polymerization temperature may be optionally selected if it is at least the minimum radical generation temperature of a polymerization initiator, but a temperature range of 50-90° C. is usable. Polymerization is also possible to be done at room temperature or slightly more by employing a polymerization initiator working at normal temperature in combination with hydrogen peroxide-reducing agent (ascorbic acid and so forth)

(Surfactant)

In order to conduct polymerization employing the foregoing radically polymerizable monomer, oil droplets are desired to be dispersed in an aqueous medium by using a surfactant. Surfactants usable in this case are not particularly limited, but ionic surfactants listed below are usable.

Examples of the ionic surfactant include sulfonate such as dodecyl benzene sulfonic acid sodium, arylalkyl polyethersulfonic acid sodium, 3,3-disulphone diphenylurea-4,4-diazo-bis-amino-8-naphthol-6-sodium sulphonate, orthocarboxy benzene-azo-dimethylaniline or 2,2,5,5-tetramethyl-triphenyl methane-4,4-diazo-bis-β-naphthol-6-sodium sulfonate; sulfuric ester salt such as sodium dodecyl sulfate, sodium tetradecyl sulfate, pentadecyl sodium sulfate or sodium octylsulphate; and fatty acid salt such as sodium oleate, lauric acid sodium, capric acid sodium, caprylic acid sodium, caproic acid sodium, stearic acid potassium or oleic acid calcium.

Examples of the nonionic surfactant also include polyethylene oxide, polypropylene oxide, combination of polypropylene oxide and polyethylene oxide, ester of polyethyleneglycol and higher fatty acid, alkylphenol polyethylene oxide, ester of higher fatty acid and polyethyleneglycol, ester of higher fatty acid and polypropylene oxide, and sorbitan ester.

These are mainly employed for an emulsifying agent in emulsion polymerization. They may be used in other processes or other purpose of use.

(Colorant)

Inorganic pigment, organic pigment and dye are usable as a colorant.

Commonly known pigments are usable as the inorganic pigment. Specific inorganic pigments are exemplified below.

Carbon black such as furnace black, channel black, acetylene black, thermal black or lamp black is exemplified as a black pigment, and magnetic powder made of magnetite or ferrite is also employed.

These inorganic pigments can be used singly, or plural kinds can be used in combination, if desired. The addition amount of the pigment is 2-20% by weight, based on the weight of polymer, and preferably 3-15% by weight.

Commonly known organic pigments or dyes are usable as the organic pigment and the dye. The following examples of organic pigments and dyes are specifically listed Examples of pigments for magenta or red include C. I. Pigment Red 2, C. I. Pigment Red 3, C. I. Pigment Red 5, C. I. Pigment Red 6, C. I. Pigment Red 7, C. I. Pigment Red 15, C. I. Pigment Red 16, C. I. Pigment Red 48:1, C. I. Pigment Red 53:1, C. I. Pigment Red 57:1, C. I. Pigment Red 122, C. I. Pigment Red 123, C. I. Pigment Red 139, C. I. Pigment Red 144, C. I. Pigment Red 149, C. I. Pigment Red 166, C. I. Pigment Red 177, C. I. Pigment Red 178, C. I. Pigment Red 222 and so forth.

Examples of pigments for orange or yellow include C. I. Pigment Orange 31, C. I. Pigment Orange 43, C. I. Pigment Yellow 12, C. I. Pigment Yellow 13, C. I. Pigment Yellow 14, C. I. Pigment Yellow 15, C. I. Pigment Yellow 17, C. I. Pigment Yellow 93, C. I. Pigment Yellow 94, C. I. Pigment Yellow 138, C. I. Pigment Yellow 180, C. I. Pigment Yellow 185, C. I. Pigment Yellow 155, C. I. Pigment Yellow 156 and so forth.

Examples of pigments for green or cyan include C. I. Pigment Blue 15, C. I. Pigment Blue 15:2, C. I. Pigment Blue 15:3, C. I. Pigment Blue 16, C. I. Pigment Blue 60, C. I. Pigment Green 7 and so forth.

Further, examples of dyes include C. I. Solvent Red 1, C. I. Solvent Red 49, C. I. Solvent Red 52, C. I. Solvent Red 58, C. I. Solvent Red 63, C. I. Solvent Red 111, C. I. Solvent Red 122, C. I. Solvent Yellow 19, C. I. Solvent Yellow 44, C. I. Solvent Yellow 77, C. I. Solvent Yellow 79, C. I. Solvent Yellow 81, C. I. Solvent Yellow 82, C. I. Solvent Yellow 93, C. I. Solvent Yellow 98, C. I. Solvent Yellow 103, C. I. Solvent Yellow 104, C. I. Solvent Yellow 112, C. I. Solvent Yellow 162, C. I. Solvent Blue 25, C. I. Solvent Blue 36, C. I. Solvent Blue 60, C. I. Solvent Blue 70, C. I. Solvent Blue 93, C. I. Solvent Blue 95 and so forth.

These organic pigments and dyes can be used singly, or plural kinds can be used in combination, if desired. The addition amount of the pigment is 2-20% by weight, based on the weight of polymer, and preferably 3-15% by weight.

(Wax)

Toner usable in the present invention may contain wax, and the structure and composition of wax are not particularly limited. Usable examples thereof include low molecular weight polyolefin wax such as polypropylene or polyethylene; paraffin wax; Fischertropush wax, ester wax and so forth The addition amount is 1-30% by weight, based on the total weight of toner, preferably 2-20% by weight, and more preferably 3-15% by weight.

The toner usable in the present invention is preferably a toner wherein wax dissolved in a monomer is dispersed in water and polymerized to form resin particles in which an ester based compound is included, and to salt-out/fuse them with colorant particles.

(Manufacturing Process of Toner)

The toner of present invention is preferably produced by a polymerization method comprising the steps of preparing resin particles including wax via a polymerization method after dispersing a monomer solution, in which wax is dissolved, in an aqueous medium; fusing resin particles in the aqueous medium employing the foregoing resin particle dispersion; removing a surfactant and so forth by filtrating the resulting particles from the aqueous medium; drying the resulting particles; and further adding external additives and so forth into particles obtained after drying. Resin particles herein may also be colored particles. Uncolored particles are also usable as resin particles. In this case, colored particles are prepared via a fusing process in an aqueous medium after adding a colorant particle dispersion into a resin particle dispersion.

It is preferable that resin particles prepared via a polymerization process are specifically utilized as a fusing process to conduct salting-out/fusing. Further, in the case of employing uncolored resin particles, resin particles and colorant particles can be subjected to salting-out/fusing in an aqueous medium.

Further, particles are not limited to a colorant and wax, but a charge control agent constituting the toner as a component can also be added in the present process as the particles.

Incidentally, the aqueous medium is water as a principal component, and has the content of water being at least 50% by weight. Water-soluble organic solvents other than water are also provided, and examples thereof include methanol, ethanol, isopropanol, butanol, acetone, methylethyl ketone, tetrahydrofuran and so forth As a preferable polymerization method in the present invention, provided can be a radical polymerization method in which a water-soluble polymerization initiator is added into a dispersion obtained by mechanically oil-droplet-dispersing a monomer solution in which a releasing agent was dissolved in a monomer, in an aqueous medium in which a surfactant of the critical micelle concentration or less is dissolved. In this case, an oil-soluble polymerization initiator may also be added into a monomer, and be usable.

The homogenizer for dispersing oil droplets is not specifically limited, but Cleamix, an ultrasonic homogenizer, a mechanical homogenizer, Manton-Gaulin, a pressure type homogenizer and so forth, for example, can be listed.

As is described before, the colorant itself may be used by modifying the surface. The surface modification method of colorants is a method in which colorants are dispersed in a solvent, and temperature is increased to accelerate a chemical reaction after adding a surface modification agent into the resulting solution. After terminating the reaction, the resulting solution is filtrated, washing and filtrating processes are repeatedly conducted with the same solvent, and then a drying process is carried out to obtain a pigment subjected to a treatment employing the surface modification agent.

There is a process in which colorant particles can be prepared by dispersing a colorant in an aqueous medium. This dispersion treatment is carried out in a state where the surfactant concentration is arranged to at least critical micelle concentration (CMC) in water.

Although the homogenizer employed during pigment dispersion is not specifically limited, preferably listed are Cleamix, an ultrasonic homogenizer, a mechanical homogenizer, a pressure homogenizer such as Manton-Gaulin or a pressure type homogenizer, a sand grinder, and a media type homogenizer such as a Getzmann mill or a diamond fine mill.

The foregoing surfactant is usable as a surfactant utilized here.

The salting-out/fusing process is a process wherein a salting-out agent containing an alkali metal salt or an alkaline earth metal salt is added into water, in which resin particles and colorant particles exist, as a coagulant having at least the critical coagulation concentration, and subsequently the resulting solution is heated to a temperature of at least the glass transition point of the resin particles to conduct salting-out and fusing simultaneously.

Examples of the alkali metal salt and alkaline earth metal salt usable as salting-out agents include: salts of alkali metals such as lithium, potassium and sodium; and salts of alkaline earth metals such as magnesium, calcium, strontium and barium. Of these, potassium, sodium, magnesium, calcium and barium are preferable. Listed as components constituting the salt may be, for example, chlorine salt, bromine salt, iodine salt, carbonate and sulfate.

(Other Additives)

A material as a toner substance in which various functions can be given, other than a resin, a colorant and a releasing agent is usable for toner. A charge control agent and so forth are specifically provided. These components can be added via various processes such as a process of including these inside toner after adding resin particles and colorant particles simultaneously at the stage of the foregoing salting-out/fusing, a process of adding these into the resin particle itself, and so forth Similarly, usable are commonly known various charge control agents which are water-dispersible. Examples thereof include a nigrosine based dye, a metal salt of a naphthenic acid or a higher fatty acid, alkoxylated amine, a quaternary ammonium salt compound, an azo based metal complex, and a salicylic acid metal salt or its metal complex.

(External Additives)

So-called external additives can be employed for toner usable in the present invention, and added to improve fluidity and an electrostatic property, and to enhance cleaning capability These external additives are not particularly limited, and various inorganic and organic particles, and lubricants are usable.

Commonly known particles are usable as inorganic particles. Specifically usable are silica, titanium and alumina particles preferably having a number average primary particle diameter of 5-500 nm. These inorganic particles are preferably hydrophobic.

Examples of silica particles include commercially available products such as R-805, R-976, R-974, R-072, R-812 and R-809 produced by Nippon Aerosil Co., Ltd.; commercially available products such as HVK-2150 and H-200 produced by Höchst; commercially available products such as TS-720, TS-530, TS-610, H-5 and MS-5 produced by Cabot corporation Examples of titanium particles include commercially available products such as T-805 and T-604 produced by Nippon Aerosil Co, Ltd.; commercially available products such as MT-100S, MT-100BD MT-500BS, MT-600, MT-600SS and JA-1 produced by Tayca Corporation; commercially available products such as TA-300SI, TA-500, TAF-130, TAF-510, TAF-510T produced by Fuji Titanium Industry Co., Ltd.; and commercially available products such as IT-S, IT-OA, IT-OB and IT-OC produced by Idemitsu Kosan Co., Ltd.

Examples of alumina particles include commercially available products such as RFY-C and C-604 produced by Nippon Aerosil Co., Ltd.; and commercially available products such as TT-55 and so forth produced by Ishihara Sangyo Kaisha, Ltd.

Spherical organic particles having a number average primary particle diameter of approximately 10-2000 nm are usable as organic particles. These usable organic particles are formed from a homopolymer or its copolymer of styrene, methylmethacrylate or such.

As the lubricant, provided are higher fatty acid metal salts such as a stearic acid zinc salt, a stearic acid aluminum salt, a stearic acid copper salt, a stearic acid magnesium salt, a stearic acid calcium salt and so forth; an oleic acid zinc salt, an oleic acid manganese salt, an oleic acid iron salt, an oleic acid copper salt, an oleic acid magnesium salt and so forth; a palmitic acid zinc salt, a palmitic acid copper salt, a palmitic acid magnesium salt, a palmitic acid calcium salt and so forth; a linolic acid zinc salt, a linolic acid calcium salt and so forth; and a recinoleic acid zinc salt, a recinoleic acid calcium salt and so forth.

The addition amount of these external additives is preferably 0.1-5% by weight, based on the weight of toner Examples of commonly known mixers usable as a method of adding external additives include a tabular mixer, a Henschel mixer, a nauter mixer and a V-shaped mixer.

EXAMPLE

Next, the present invention will now be described in detail referring to examples, but the present invention is not limited thereto. Incidentally, "parts" in the description represents "parts by weight", unless otherwise specifically mentioned.

[Developing Roller Coating Solution]

(Polyamide Resin Solution)

(1) Preparation of Polyamide Resin-containing Layer Forming Material 1

After a urethane resin (Nippolan 5199 produced by Nippon Polyurethane Industry Co., Ltd.) was mixed in a polyamide resin (N-1), and 30 parts by weight of Ketchen Black (carbon black) was mixed, isopropyl alcohol was added into the system to prepare polyamide resin-containing layer forming material 1 containing 52% by weight of polyamide resin (N-1) (the value "% by weight" calculated by excluding the content of volatile matter such as a solvent generated in a drying process; hereinafter, the same as this).

(2) Preparation of Polyamide Resin-containing Layer Forming Material 2

After a urethane resin (Nippolan 5199 produced by Nippon Polyurethane Industry Co., Ltd.) was mixed in a polyamide resin (N-3), and 30 parts by weight of Ketchen Black (carbon black) was mixed, isopropyl alcohol was added into the system to prepare polyamide resin-containing layer forming material 2 containing 63% by weight of polyamide resin (N-3) (no volatile matter content included).

(3) Preparation of Polyamide Resin-containing Layer Forming Material 3

After a urethane resin (Nippolan 5199 produced by Nippon Polyurethane Industry Co., Ltd.) was mixed in a polyamide resin (N-5), and 30 parts by weight of Ketchen Black (carbon black) was mixed, isopropyl alcohol was added into the system to prepare polyamide resin-containing layer forming material 2 containing 71% by weight of polyamide resin (N-5) (no volatile matter content included).

(4) Preparation of Polyamide Resin-containing Layer Forming Material 4

After a urethane resin (Nippolan 5199 produced by Nippon Polyurethane Industry Co., Ltd.) was mixed in a polyamide resin (N-11), and 30 parts by weight of Ketchen Black (carbon black) was mixed, isopropyl alcohol was added into the system to prepare polyamide resin-containing layer forming material 4 containing 74% by weight of polyamide resin (N-11) (no volatile matter content included).

(5) Preparation of Polyamide Resin-containing Layer Forming Material 5

After a urethane resin (Nippolan 5199 produced by Nippon Polyurethane Industry Co., Ltd.) was mixed in a polyamide resin (N-13), and 30 parts by weight of Ketchen Black (carbon black) was mixed, isopropyl alcohol was added into the system to prepare polyamide resin-containing layer forming material 5 containing 64% by weight of polyamide resin (N-13) (no volatile matter content included).

(Silicone Copolymer Polyurethane Resin Solution)

(1) Preparation of Silicone Copolymer Polyurethane Resin-containing Layer Forming Material 1

Into a reaction vessel fitted with a stirrer, a thermometer, a nitrogen gas introducing tube and a reflux condenser, 310 parts of ε-caprolactone, 150 parts of alcohol-modified siloxane oil (exemplified compound 3-3), and 0.05 parts of tetrahutyl titanate were charged, and the system was reacted under nitrogen gas stream at 180° C. for 10 hours to prepare "polysiloxane-polyester copolymer 1". Thus, the resulting "polysiloxane-polyester copolymer 1" had a hydroxyl group value of 37, an acid value of 0.40 and a number average molecular weight of 3,030.

One hundred and fifty parts of the above-described copolymer and 27 parts of 1,4-butanediol were dissolved in a mixed solvent composed of 200 parts of methyl ethyl ketone and 100 parts of dimethylformamide, and an admixture in which 91 parts of water-added diphenylmethanediisocyanate (hereinafter, also referred to water-added MDI) was dissolved in 188 parts of dimethylformamide was gradually dripped while stirring at 60° C. After completion of dripping, reaction was conducted at 80° C. for 6 hours to prepare "silicone copolymer polyurethane resin solution 1". Thus, the resulting "silicone copolymer polyurethane resin solution 1" exhibited very high transparency, and had a solid content of 35% by weight and a viscosity at 25° C. of 35.5 Pa·s.

After a urethane resin (Nippolan 5199 produced, by Nippon Polyurethane Industry Co., Ltd.) was mixed in "silicone copolymer polyurethane resin 1", and 30 parts by weight of Ketchen Black (carbon black) and 40% by weight of cross-linked urethane resin particles having a number average primary particle diameter of 20 μm were further mixed in the system to prepare "silicone copolymer polyurethane resin-containing layer forming material 1" containing 54 W by weight of "silicone copolymer polyurethane resin 1" (the value "% by weight" calculated by excluding the content of volatile matter such as a solvent generated in a drying process; hereinafter, the same as this).

(2) Preparation of Silicone Copolymer Polyurethane Resin-containing Layer Forming Material 2

Seventy five parts of the foregoing "polysiloxane-polyester copolymer 1", 75 parts of polybutylene adipate (a hydroxyl group value of 56.0, an acid value of 0.40 and a number average molecular weight of 2,000) and 27 parts of 1,4-butanediol were dissolved in a mixed solvent composed of 200 parts of methyl ethyl ketone and 150 parts of dimethylformamide, and an admixture in which 90 parts of water-added MDI was dissolved in 146 parts of dimethylformamide was gradually dripped while stirring at 60° C. After completion of dripping, reaction was conducted at 80° C. for 6 hours to prepare "silicone copolymer polyurethane resin solution 2". Thus, the resulting "silicone copolymer polyurethane resin solution 2" exhibited very high transparency, and had a solid content of 35% by weight and a viscosity at 25° C. of 312 Pa·s.

After a urethane resin (Nippolan 5199 produced by Nippon Polyurethane Industry Co., Ltd.) was mixed in "silicone copolymer polyurethane resin 2", and 30 parts by weight of Ketchen Black (carbon black) and 40% by weight of cross-linked urethane resin particles having a number average primary particle diameter of 20 μm were further mixed in the system to prepare "silicone copolymer polyurethane resin-containing layer forming material 2" containing 60% by weight of "silicone copolymer polyurethane resin 2" (no volatile matter content included).

(3) Preparation of Silicone Copolymer Polyurethane Resin-containing Layer Forming Material 3

Into a reaction vessel fitted with a stirrer, a thermometer, a nitrogen gas introducing tube and a reflux condenser, 166 parts of ε-caprolactone, 150 parts of alcohol-modified siloxane oil (exemplified compound 3-6), and 0.04 parts of tetrabutyl titanate were charged, and the system was reacted under nitrogen gas stream at 180° C. for 10 hours to prepare "polysiloxane-polyester copolymer 2". Thus, the resulting "polysiloxane-polyester copolymer 2" had a hydroxyl group value of 28, an acid value of 0.35 and a number average molecular weight of 4,010.

One hundred and fifty parts of the above-described copolymer and 27 parts of 1,4-butanediol were dissolved in a mixed solvent composed of 200 parts of methyl ethyl ketone and 100 parts of dimethylformamide, and an admixture in which 88 parts of water-added MDI was dissolved in 192 parts of dimethylformamide was gradually dripped while stirring at 60° C. After completion of dripping, reaction was conducted at 80° C. for 6 hours to prepare "silicone copolymer polyurethane resin solution 3". Thus, the resulting "silicone copolymer polyurethane resin solution 3" had a solid content of 35% by weight and a viscosity at 25° C. of 312 Pa·s.

After a urethane resin (Nippolan 5199 produced by Nippon Polyurethane Industry Co., Ltd.) was mixed in "silicone copolymer polyurethane resin 3", and 30 parts by weight of Ketchen Black (carbon black) and 40% by weight of cross-linked urethane resin particles having a number average primary particle diameter of 20 μm were further mixed in the system to prepare "silicone copolymer polyurethane resin-containing layer forming material 3" containing 70% by weight of "silicone copolymer polyurethane resin 3" (no volatile matter content included).

(4) Preparation of Silicone Copolymer Polyurethane Resin-containing Layer Forming Material 4

Seventy five parts of the foregoing forming material 3, 75 parts of polyethylene adipate (a hydroxyl group value of 56.0, an acid value of 0.28 and a number average molecular weight of 2,000) and 27 parts of 1,4-butanediol were dissolved in a mixed solvent composed of 200 parts of methyl ethyl ketone and 150 parts of dimethylformamide, and an admixture in which 93 parts of MDI was dissolved in 151 parts of dimethylformamide was gradually dripped while stirring at 60° C. After completion of dripping, reaction was conducted at 80° C. for 6 hours to prepare "silicone copolymer polyurethane resin solution 4". Thus, the resulting "silicone copolymer polyurethane resin solution 4" exhibited high transparency, and had a solid content of 35% by weight and a viscosity at 25° C. of 40.5 Pa·s.

After a urethane resin (Nippolan 5199 produced by Nippon Polyurethane Industry Co., Ltd.) was mixed in "silicone copolymer polyurethane resin 4", and 30 parts by weight of Ketchen Black (carbon black) and 40% by weight of cross-linked urethane resin particles having a number average primary particle diameter of 20 μm were further mixed in the system to prepare "silicone copolymer polyurethane resin-containing layer forming material 4" containing 75% by weight of "silicone copolymer polyurethane resin 4" (no volatile matter content included).

(5) Preparation of Silicone Copolymer Polyurethane Resin-containing Layer Forming Material 5

Into 20 parts of silicone based macromonomer (FM0275, produced by Chisso Corporation) having a number average molecular weight of 10,000, 60 parts of methyl methacrylate, 10 parts of butyl acrylate, 5 parts of 2-hydroxyethyl methacrylate and 5 parts of methacrylic acid in a flask fitted with a stirrer, a condenser, a thermometer and a nitrogen gas introducing tube, 1.5 parts of dimethyl-2,2'-azobis-isobutylate (MAIB) as a polymerization initiator and 100 parts of methyl ethyl ketone as a solvent were added, and reacted at 70° C. for 6 hours while bubbling nitrogen gas to synthesize "silicone based graft copolymer resin" having a solid content of 50% by weight.

Thus, the resulting "silicone based graft copolymer resin" was mixed with acrylic resin (ACRYPET VH produced by Sumitomo Chemical Co., Ltd.), and 30 pats of Ketchen Black (carbon black) and 40 parts of cross-linked urethane resin particles having a number average primary particle diameter of 20 μm were further mixed to prepare "silicone copolymer vinyl polymer resin-containing layer forming material 5 containing 59% by weight of "silicone based graft copolymer resin" (no volatile matter content included).

[Preparation of Developing Roller]

(a) Preparation of Developing Roller 1

"Polyamide resin-containing layer forming material 1" was coated 15 μm in thickness on the circumferential surface of a shaft made from SUS 303 having a diameter of 10 mm, and heated at 100° C. for one hour to form a layer containing 52% by weight of the polyamide resin. Then, "silicone copolymer polyurethane resin-containing layer forming material 1" was coated 15 μm in thickness, and heated at 100° C. for one hour to form a surface layer containing 54% by weight of the silicone copolymer polyurethane resin. In this way, developing roller 1 was prepared.

(b) Preparation of Developing Roller 2

A layer containing 65% by weight of a polyamide resin was formed similarly to the preparation of developer roller 1, except that "polyamide resin-containing layer forming material 2" was coated 10 μm in thickness in place of "polyamide resin-containing layer forming material 1" employed for the preparation of developing roller 1. Then, "developing roller 2" having a surface layer containing 60% by weight of a silicone copolymer polyurethane resin was prepared similarly to the preparation of developing roller 1, except that "silicone copolymer polyurethane resin-containing layer forming material 2 was employed in place of "silicone copolymer polyurethane resin-containing layer forming material 1".

(c) Preparation of Developing Roller 3

A layer containing 71% by weight of a polyamide resin was formed similarly to the preparation of developer roller 1, except that "polyamide resin-containing layer forming material 3" was coated 12 μm in thickness in place of "polyamide resin-containing layer forming material 1" employed for the preparation of developing roller 1. Then, "developing roller 3" having a surface layer containing 70% by weight of a silicone copolymer polyurethane resin was prepared similarly to the preparation of developing roller 1, except that "silicone copolymer polyurethane resin-containing layer forming material 3 was employed in place of "silicone copolymer polyurethane resin-containing layer forming material 1".

(d) Preparation of Developing Roller 4

A layer containing 74% by weight of a polyamide resin was formed, similarly to the preparation of developer roller 1, except that "polyamide resin-containing layer forming material 4" was employed in place of "polyamide resin-containing layer forming material 1" employed for the preparation of developing roller 1. Then, "developing roller 4" having a surface layer containing 75% by weight of a silicone copolymer polyurethane resin was prepared similarly to the preparation of developing roller 1, except that "silicone copolymer polyurethane resin-containing layer forming material 4 was employed in place of "silicone copolymer polyurethane resin-containing layer forming material 1".

(e) Preparation of Developing Roller 5

A layer containing 64% by weight of a polyamide resin was formed similarly to the preparation of developer roller 1, except that "polyamide resin-containing layer forming material 5" was employed in place of "polyamide resin-containing layer forming material 1" employed for the preparation of developing roller 1. Then, "developing roller 5" having a surface layer containing 75% by weight of a silicone copolymer polyurethane resin was prepared similarly to the preparation of developing roller 1, except that "silicone copolymer vinyl polymer resin-containing layer forming material 5 was employed in place of "silicone copolymer polyurethane resin-containing layer forming material 1".

(f) Preparation of Comparative Developing Roller 1

"Comparative developing roller 1" was prepared similarly to the preparation of developing roller 1, except that in place of "polyamide resin-containing layer forming material 1", bis-1,2-triethoxysilylethane was evenly coated, and heat-treated at 100° C. for one hour to form a layer.

(g) Preparation of Comparative Developing Roller 2

One hundred parts of urethane resin (Nippolan 5199 produced by Nippon Polyurethane Industry Co., Ltd.), 30 parts of Ketchen Black, 40 parts of urethane resin particles having an average particle diameter of 20 μm (Vurnock CFB100 produced by Dainippon Ink & Chemicals, Inc.) and 400 parts of methyl ethyl ketone were mixed and dispersed to prepare "comparative surface layer forming material 1".

"Comparative developing roller 2" was prepared similarly to the preparation of "developing roller 1", except that the foregoing "comparative surface layer forming material 1" was employed in place of "silicone copolymer polyurethane resin-containing layer forming material 1".

[Preparation of Toner]

(1) Preparation of "Resin Particle Dispersion 1"

In a flask fitted with a stirrer, 72.0 g of pentaerythritol tetrastearate was added into a monomer mixture composed of 115.1 g of styrene, 42.0 g of n-butyl acrylate and 10.9 g of methacrylic acid, and dissolved while heating at 80° C.

On the other hand, a surfactant solution in which 7.08 g of an anionic surfactant (sodium dodecylbenzenesulfonate: SDS) was dissolved in 2,769 g of deionized water was charged into a separable flask fitted with a stirrer, a temperature sensor, a cooling pipe and a nitrogen introducing tube, and heated to 80° C. while stirring at a stirring speed of 230 rpm under nitrogen gas stream. Then the above monomer solution (80° C.) was mixed and dispersed in the foregoing surfactant solution with a mechanical dispersing machine, CLEARMIX manufactured by M-Tech Co., Ltd., having a circulation pass to prepare an emulsified solution in which emulsified particles (oil droplets) having a uniform dispersed particle diameter are dispersed.

An initiator solution in which 0.84 g of a polymerization initiator (potassium persulfate: KPS) was dissolved in 200 g of deionized water was added into this dispersion, and the system was heated and stirred for 3 hours at 80° C. to conduct polymerization reaction. A solution in which 7.73 g of polymerization initiator (KPS) was dissolved in 240 g of deionized water was added into the resulting reaction solution, the temperature was set to 80° C. after 15 minutes, and a mixed solution composed of 383.6 g of styrene, 140.0 g of n-butyl acrylate, 36.4 g of methacrylic acid and 12 g of n-octylmercaptan was dripped spending 100 minutes. This system was heated and stirred for 60 minutes at 80° C. and then cooled by 40° C. to prepare a resin particle dispersion containing wax {hereinafter, referred to as "latex (1)"}

(2) Preparation of "Colorant Dispersion K"

On the other hand, 9.2 g of sodium n-dodecylsulfate was dissolved in 160 g of deionized water, 20 g of carbon black (Mogal L, produced by Cabot Co., Ltd.) as a colorant was gradually added, and subsequently dispersed with a mechanical dispersing machine (CLEARMIX, manufactured by M-Tech Co., Ltd.) to prepare "colorant dispersion K". The particle diameter of the colorant particle in "colorant dispersion K" measured by an electrophoretic light scattering photometer (ELS-800, manufactured by Otsuka Electronics Co., Ltd.) was 120 nm.

(3) Preparation of "Colored Particle 1K"

Into a reaction vessel (four-necked flask) fitted with a thermal sensor, a cooling pipe, a stirrer (two stirring blades and a crossing angle of 20°) and a shape monitoring device, charged were 1250 g of "resin particle dispersion 1" (solid content conversion), 2,000 g of deionized water and the total amount of "colorant dispersion K" and the interior temperature was adjusted to 25° C. After setting the inner temperature to 25° C., 5 mol/liter of an aqueous sodium hydroxide solution was added into this dispersion mixed solution dispersion to adjust the pH to 10.0. Then, an aqueous solution in which 52.6 g of magnesium chloride hexahydrate was dissolved in 72 g of deionized water was added into the system spending 10 minutes while stirring at 25° C. Immediately after this, temperature was raised, and the system was heated to 95° C. spending for 5 minutes (at a rising speed of 14° C./minute).

In this situation, the particle diameter of coagulated particles was measured by Multisizer 3 (manufactured by Beckman-Coulter Co., Ltd.), and a solution in which 115 g of sodium chloride was dissolved in 700 g of deionized water was added to stop particle growth at a time when the volume based median particle diameter ($D_{50v}$) reached 6.5 μm. The system was further heated and stirred at 90° C. for 8 hours (at a stirring rotation speed of 120 rpm) to continuously conduct a fusing treatment for ripening Subsequently, the system was cooled down to 30° C. at a cooling rate of 10° C./minute, and the pH was adjusted to 3.0 by adding hydrochloric acid, and then stirring was stopped.

The resulting particles were filtrated, and repeatedly washed with deionized water to conduct a submerged classification treatment employing a centrifugal separator. After this, prepared was "colored particle 1K" having a moisture content of 1.0% by weight obtained via a drying process employing a flash jet dryer.

(4) Preparation of "Colorant Dispersion Y"

"Colorant dispersion Y" was prepared similarly to the preparation or "colorant dispersion K", except that 20 g of a pigment "C. I. Pigment Yellow 74" was employed in place of 20 g of carbon black. The diameter of colorant particles in "colorant dispersion Y" measured by an electrophoretic light scattering photometer (ELS-800, manufactured by Otsuka Electronics Co., Ltd.) was 120 nm in weight average particle diameter.

(5) Preparation of "Colorant Dispersion M"

"Colorant dispersion M" was prepared similarly to the preparation of "colorant dispersion K", except that 20 g of a quinacridone based magenta pigment "C. I. Pigment Red 122" was employed in place of 20 g of carbon black. The diameter of colorant particles in "colorant dispersion M" measured by an electrophoretic light scattering photometer (ELS-800, manufactured by Otsuka Electronics Co., Ltd.) was 120 nm in weight average particle diameter.

(6) Preparation of "Colorant Dispersion C"

"Colorant dispersion C" was prepared similarly to the preparation of "colorant dispersion K", except that 20 g of a phthalocyanine based pigment "C. I. Pigment Blue 15:3" was employed in place of 20 g of carbon black. The diameter of colorant particles in "colorant dispersion C" measured by an electrophoretic light scattering photometer (ELS-800, manufactured by Otsuka Electronics Co., Ltd.) was 120 nm in weight average particle diameter.

(7) Preparation of "Colored Particle 1Y"

"Colored particle 1Y" was prepared similarly to the preparation of "colored particle 1K", except that the total amount of "colorant dispersion K" was replaced by the total amount of "colorant dispersion Y".

(8) Preparation of "Colored Particle 1M"

"Colored particle 1M" was prepared similarly to the preparation of "colored particle 1K", except that the total amount of "colorant dispersion K" was replaced by the total amount of "colorant dispersion M".

(9) Preparation of "Colored Particle 1C"

"Colored particle 1C" was prepared similarly to the preparation of "colored particle 1K", except that the total amount of "colorant dispersion K" was replaced by the total amount of "colorant dispersion C".

(10) Preparation of Toner

Into the above-described "colored particle 1K", added were 0.8 parts by weight of hydrophobic silica having a number average primary particle diameter of 12 nm and a hydrophobicity of 65 and 0.5 parts by weight of hydrophobic titania having a number average primary particle diameter of 30 nm and a hydrophobicity of 55, and the system was mixed with a Henschel mixer to prepare toners. These were designated as toner 1K, toner 1Y, toner 1M and toner 1C, respectively.

[Performance Evaluation]

(1) Evaluation of Adhesiveness of Developing Roller

As to the resulting developing roller, as shown in FIG. 2(*a*), incisions with a width of 2.5 cm indicated by dashed line X were made along with outer circumferential surface of a resin layer at the roller center portion, and an incision (dashed line Y) was further made in the shaft direction on the resin layer. The resin layer was slightly peeled from the incised portion, and then the end of the peeled resin layer was raised vertically employing "Autograph AGS, manufactured by Shimadzu Corporation" (Z-pointing arrow direction), as shown in FIG. 2(*b*). How much force was necessary to start peeling off the resin layer was measured to evaluate the adhesion. In addition, the lifting speed of the resin layer was 100 mm/minute. Samples with a load at a time when the resin layer starts to be peeled off being at least 4.0 N are judged as acceptable.

(2) Image Evaluation

The above-described developing rollers were each installed in the developing device to make evaluation employing a commercially available color laser printer Magicolor 2300DL, manufactured by Konica Minolta Business Technologies Inc. Three thousand A4 size print sheets were continuously printed at a pixel ratio of 20% (5% each of yellow, magenta, cyan and black in full color mode) at room temperature and low humidity (20° C. and 10%RH). Evaluation samples were made by printing an original image having a pixel ratio of 10% (an A4 size original image document allocating four equal quarters for each of a fine line image, a color portrait, a solid white image, and a solid black image) at the initial printing stage and after printing 3000 print sheets to make the following evaluation.

<Fine Line Reproduction>

The fine line image portion was magnified employing a loupe at a magnification of 10 times, and the number of fine lines in 1 mm was evaluated to determine resolution.

<Density Unevenness>

The reflective density at ten selected portions on a solid black image (a pixel ratio of 100%) was randomly measured employing a Macbeth reflective densitometer (RD-918), and the density unevenness was evaluated via difference between the highest and lowest solid image densities. In any of the cases at the initial printing stage and after printing 3,000 print sheets, samples in which the difference between the highest and lowest solid image densities is less than 0.10 are judged as acceptable.

<Fog Density>

The solid white image was evaluated in relative reflection density in which reflective density of a transfer sheet was set to 0, employing a Macbeth reflection densitometer (RD-918). In any of the cases at the initial printing stage and after printing 3,000 print sheets, samples in which the difference is less than 0.010 are judged as acceptable.

Results are shown in Table 1.

TABLE 1

| | Developing roller | Peeling strength | Image evaluation | | | | | |
|---|---|---|---|---|---|---|---|---|
| | | | Resolution (lines) | | Fog | | Density unevenness | |
| | No. | (N) | *1 | *2 | *1 | *2 | *1 | *2 |
| Example 1 | 1 | 7.8 | 6 | 6 | 0.001 | 0.003 | 0.02 | 0.03 |
| Example 2 | 2 | 11.7 | 6 | 6 | 0.001 | 0.002 | 0.01 | 0.02 |
| Example 3 | 3 | 12.5 | 6 | 6 | 0.000 | 0.001 | 0.00 | 0.01 |
| Example 4 | 4 | 12.3 | 6 | 6 | 0.000 | 0.001 | 0.01 | 0.03 |
| Example 5 | 5 | 10.4 | 6 | 6 | 0.001 | 0.003 | 0.02 | 0.04 |
| Comparative example 1 | Comparative 1 | 3.3 | 6 | 4 | 0.001 | 0.018 | 0.02 | 0.19 |
| Comparative example 2 | Comparative 2 | 2.7 | 6 | 4 | 0.001 | 0.016 | 0.02 | 0.21 |

*1: at initial printing stage,
*2: after printing 3,000 print sheets

As is clear from Table 1, it is to be understood that excellent adhesion between the resing layer and the shaft is obtained in Examples 1-5 of the present invention. It is also to be understood that the fine line reproduction is maintained, no generation of fog is observed, and image defects caused by remaining charge are not generated, after continuously printing 3,000 print sheets. On the other hand, it is confirmed that insufficient adhesion is obtained, and fine line reproduction failure and fog caused by image blur are also generated before printing 3,000 print sheets in Comparative examples 1 and 2, whereby image formation can not be stably conducted.

The developing roller having a resin layer comprising a surface layer containing a silicone copolymer resin as a principal component and a layer containing a polyamide resin as a principal component, that is provided immediately below the surface layer, is provided around the outer circumferential surface of the conductive shaft, whereby printed matters exhibiting excellent image quality can be stably obtained even thought the image formation is repeatedly carried out.

EFFECT OF THE INVENTION

In the present invention, provided can be a developing roller comprising a surface layer capable of suppressing the residual potential during repetitive use with no damage of interlayer adhesiveness, preventing toner leakage and contaminations caused by adhesion matter on the surface, and preventing developing unevenness because of even toner electrification; and can also be an image forming method employing the developing roller.

What is claimed is:

1. A developing roller comprising a conductive shaft, and a resin layer provided around an outer circumferential surface of the conductive shaft, wherein the resin layer comprises a surface layer containing a silicone copolymer resin as a principal component and a layer containing a polyamide resin as a principal component, that is provided immediately below the surface layer, and immediately above the shaft.

2. The developing roller of claim 1, wherein the silicone copolymer resin comprises a urethane bond.

3. A developing device employing the developing roller of claim 1.

4. An image forming method comprising the steps of:

(a) conveying a non-magnetic single component developer to a developing region of a developing device with a developing roller; and (b) developing an electrostatic latent image formed on an electrostatic latent image carrier with the developer, wherein the developing roller comprises a resin layer provided on an outer circumferential surface of a conductive shaft, and the resin layer comprises a surface layer containing a silicone copolymer resin as a principal component, and a layer containing a polyamide resin as a principal component, that is provided immediately below the surface layer, and immediately above the shaft.

5. The image forming method of claim 4, wherein the silicone copolymer resin comprises a urethane bond.

* * * * *